US008898840B1

(12) United States Patent
Majette

(10) Patent No.: US 8,898,840 B1
(45) Date of Patent: Dec. 2, 2014

(54) HEAD AND NECK SUPPORT DEVICE

(71) Applicant: Michael S. Majette, Tampa, FL (US)

(72) Inventor: Michael S. Majette, Tampa, FL (US)

( * ) Notice: Subject to any disclaimer, the term of this patent is extended or adjusted under 35 U.S.C. 154(b) by 29 days.

(21) Appl. No.: 13/663,142

(22) Filed: Oct. 29, 2012

Related U.S. Application Data

(60) Provisional application No. 61/628,313, filed on Oct. 28, 2011.

(51) Int. Cl.
*A47C 7/38* (2006.01)
*A47C 16/00* (2006.01)
*A47G 9/10* (2006.01)

(52) U.S. Cl.
CPC ..... *A47G 9/1081* (2013.01)
USPC ..... 5/637; 5/640; 5/643; 297/393; 297/397

(58) Field of Classification Search
CPC ... A47G 9/1009; A47G 9/1081; A47C 21/026
USPC ..... 5/637, 640, 643, 491; 297/393, 397
See application file for complete search history.

(56) References Cited

U.S. PATENT DOCUMENTS

| | | | | |
|---|---|---|---|---|
| 4,297,994 | A | 11/1981 | Bashaw | |
| 4,771,493 | A | 9/1988 | Park | |
| 5,596,780 | A | 1/1997 | Brenn | |
| 5,613,736 | A * | 3/1997 | Schaked et al. | 297/397 |
| 5,615,432 | A | 4/1997 | Von Ohlen, III | |
| 5,768,725 | A | 6/1998 | Brenn | |
| 5,778,469 | A | 7/1998 | Festa | |
| 5,918,335 | A | 7/1999 | Han | |
| 5,970,546 | A | 10/1999 | Danis | |
| 5,974,607 | A | 11/1999 | Smith | |
| 6,108,840 | A | 8/2000 | Heimbrock et al. | |
| 6,123,389 | A * | 9/2000 | O'Connor et al. | 297/397 |
| 6,182,313 | B1 | 2/2001 | Eschenbach | |
| 6,305,749 | B1 * | 10/2001 | O'Connor et al. | 297/397 |
| 6,484,336 | B1 | 11/2002 | Berke et al. | |
| 6,640,367 | B2 * | 11/2003 | Hsia | 5/640 |
| 7,080,420 | B2 | 7/2006 | Damron | |
| 7,426,763 | B2 | 9/2008 | Mazzei et al. | |
| 7,555,794 | B2 | 7/2009 | Zelnik et al. | |
| 7,640,609 | B2 | 1/2010 | Roleder et al. | |
| 7,673,356 | B1 | 3/2010 | Conyers | |
| 7,788,749 | B1 | 9/2010 | Ku | |
| 7,938,491 | B2 | 5/2011 | Montuore | |
| 8,239,987 | B2 * | 8/2012 | Sharp | 5/639 |
| 2003/0135927 | A1 | 7/2003 | Hsia | |
| 2005/0066444 | A1 | 3/2005 | Mazzei et al. | |
| 2008/0271742 | A1 | 11/2008 | Maginness | |
| 2009/0019641 | A1 * | 1/2009 | Ali | 5/636 |
| 2009/0025146 | A1 | 1/2009 | Mazzei et al. | |

* cited by examiner

*Primary Examiner* — Michael Trettel
(74) *Attorney, Agent, or Firm* — Frijouf, Rust & Pyle, P.A.

(57) ABSTRACT

A head and neck support device is disclosed for positioning about a neck of an individual. A generally U-shaped pillow encircles the neck. The head and neck support device comprises a rear supporting panel, primary supporting panel and a secondary supporting panel for defining a pillow enclosure frame and a pillow cavity. The pillow cavity receives the generally U-shaped pillow. The primary supporting panel applies a first opposing force for supporting the head and neck in a generally vertical position. The secondary supporting panel applies a second opposing force for supporting the head and neck in a generally vertical position.

22 Claims, 28 Drawing Sheets

PRIOR ART

HEAD AND NECK SUPPORT DEVICE

CROSS-REFERENCE TO RELATED APPLICATIONS

This application claims benefit of U.S. Patent Provisional application Ser. No. 61/628,313 filed Oct. 28, 2011. All subject matter set forth in provisional application Ser. No. 61/628,313 is hereby incorporated by reference into the present application as if fully set forth herein.

BACKGROUND OF THE INVENTION

1. Field of the Invention

This invention relates to a support device and more particularly to a head and neck support device.

2. Background of the Invention

The cervical spine comprises seven vertebrae which begin at the base of the skull. These vertebrae are smaller in size than other spinal vertebrae. The cervical spine supports the skull and enables the skull to rotate side to side as well as to bend forward and backward. Additionally the cervical spine protects the spinal cord from injury. A highly complex system comprising ligaments, tendons and muscles supports and stabilizes the cervical spine, and prevents excessive movements, thereby preventing injury.

As a nerve exits the spinal canal it can be pinched causing moderate to severe pain. It is obvious to those skilled in the art that proper support of the cervical spine and skull (head) is necessary while resting, in order to prevent inadvertent movement which may result in a cervical spine injury. The resting support required is especially important while resting in a sitting position for a substantial period of time, as in airline travel.

Many in the prior art have attempted to solve this problem with a wide variety of cervical spine and head supports. Many of these supports suffer from the problem of shape distortion upon use. As a user places the cervical spine and head cushion support in place and maintains the support in place, over a short period of time the support begins to change shape, resulting in inadequate cervical spine and head support.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 4,297,994 to Bashaw discloses a method and apparatus for immobilizing a head and neck of a patient on a support. The apparatus comprises sliding a base between the patient and the support or attaching device to support prior-until the center portion of a U-shaped headband affixed to the base abuts the top of the head of the patient. The base is attached to the support, and a first cushion is positioned and attached to an end portion of the headband next to, and in contact with, one side of the head of the patient. The first cushion is secured in position to the base with a first fastener. A second cushion is positioned and attached to the other end portion of the headband next to, and in contact with, the other side of the head. The second cushion in positioned and secured to the base with a second fastener such that the central portion of the U-shaped headband is snug against the top of the head. A chin strap is secured, cradling the chin of the patient by attaching the strap to the end portion of the U-shaped headband with a third fastener. Thereby the neck and head of the patient is immobilized on the support from lateral or longitudinal movement. Additionally, a forehead band can be placed over the forehead of the patient, and attached to the end portions of the U-shaped head with a fourth fastener, thereby further restraining the head of the patient. A tension strap, attached to the base where the headband is attached to the base, can be placed under tension and secured to the support to provide traction to the head and neck of the patient. The fastener can comprise complementary hook-and-loop interlocking fabric pieces. The base can be attached to the support by elastic strips having hooks on their ends, which strips are affixed to the base.

U.S. Pat. No. 4,771,493 to Park discloses an adjustable therapeutic pillow apparatus for applying a gentle traction force to the head, neck and shoulders region of a user. The apparatus includes a base, first and second pillow members having spaced-apart convex pillow surfaces for engagement with the user, and means for fastening the pillow members to the base. The apparatus is adjustable in that both the lateral spacing of the pillow members and the overall length of the pillow members may be adjusted.

U.S. Pat. No. 5,596,780 to Brenn discloses a headrest which can be used on an operating table to maintain the head of a supine, unconscious patient in steady position for the surgeon to conduct an operation. The headrest has a low profile to provide maximum unobstructed access to the top, forehead, sides and face of the head. The headrest includes two, tapered, elongated lobes rigidly spaced apart in a V-shape configuration which allows one headrest to fit many different size heads. In use, the patient's head is wedged at points of tangency between the lobes. The V-shape configuration also permits the surgeon to easily adjust the head position to a new, steady position with only minor head movement, and therefore, reduced risk of dislodging the patient's breathing tube.

U.S. Pat. No. 5,615,432 to Von Ohlen III discloses an apparatus for supporting an individual's head or neck which includes a base member and a cushion portion being removably mounted on and spaced from the base member. The cushion portion includes a first section adapted to support an individual's head or neck, and additional recessed regions extending angularly from each end of the first section to form a substantially u-shaped cushion portion. The cushion portion is selectably engageable with an individual's head or neck forming an air channel when an individual lies in a horizontal prone position.

U.S. Pat. No. 5,768,725 to Brenn discloses a headrest which can be used on an operating table to maintain the head of a supine, unconscious patient in steady position for the surgeon to conduct an operation. The headrest has a low profile to provide maximum unobstructed access to the top, forehead, sides and face of the head. The headrest includes two, tapered, elongated lobes rigidly spaced apart in a V-shape configuration which allows one headrest to fit many different size heads. In use, the patient's head is wedged at points of tangency between the lobes. The V-shape configuration also permits the surgeon to easily adjust the head position to a new, steady position with only minor head movement, and therefore, reduced risk of dislodging the patient's breathing tube.

U.S. Pat. No. 5,778,469 discloses a new therapeutic cervical pillow for aiding individuals with cervical spine aliments. The inventive device includes a concave pillow member having a back portion having an arcuate surface, and a pair laterally opposing arcuate side portions extending from the back portion. The arcuate side portions and said back portion arcuate surface define a concavity for accepting the neck of a person for supporting the cervical spine when in a seated position. A pivot pin is employed to permit pivoting of each of the side portions of the pillow relative to the back portion and the other side portion of the pillow.

U.S. Pat. No. 5,918,335 to Han discloses a baby pillow including a base plate and two frames connected to two sides of the base plate. A cotton body surrounds each frame, and a layer of cotton cloth is made to cover the base plate and the two side cotton bodies. A soft cushion layer is formed with a cotton bag filled with cotton and then sewed with a side of the cotton cloth of the base plate, and then folded to overlap the base plate. The head of a baby may be laid on the soft cushion layer overlapped on the base plate, with the two side cotton bodies folded up to two sides of the head of the baby to help prevent the head from turning to a side, keeping it in a normal position, and preventing noise from reaching the ears of the baby to permit it to sleep soundly.

U.S. Pat. No. 5,970,546 to Danis discloses a portable headrest for sunbathing including a head support member having a generally U-shaped configuration. The head support member includes an outer material covering, an internal foam support cushion and a rigid support plate on the bottom thereof. A rigid base support member having a generally curved-shaped configuration provides a stable support on sand, soft ground, or grass. A plurality of spaced-apart support connecting members connects the head support member to the base support member and the plurality of spaced-apart support connecting members defines a plurality of air passageways between the bottom of the head support member and the top of the base support member for allowing the passage of air therethrough to the user's face when the face is embedded in the head support member.

U.S. Pat. No. 5,974,607 to Smith discloses a head clip pillow designed for being worn about the neck of a user to cover the user's ears in order to eliminate a substantial portion of ambient noise while providing support for the user's head. The pillow defines a substantially U-shaped configuration for being received about the back of the neck of a user. The central portion of the pillow defines a height to be received by the nape of the neck, while the terminal portions of the pillow define a height to cover the sides of the user's face, including the ears. A base member fabricated from a resilient material defines a contour substantially proportional to the overall contour of the pillow. A spring member is received about a portion of the base member. The spring member is configured to apply a biasing force about the neck of the user. Pressure applied to other areas of the user's head is accomplished indirectly through the base member. Surrounding the base member and spring is at least one layer of foam rubber or other cushioning type material. A cover is provided for maintaining the integrity of the internal pillow components. The cover is configured to be closely received about the entirety of the pillow to provide a smooth surface over the entire surface thereof. A removable cover is provided to protect the pillow and may be removed for cleaning or replacement thereof. An alternate embodiment includes a pocket defined on the interior of each side of the removable cover. The pocket has a convention closure device and is configured to receive a therapeutic treatment device such as a conventional hot/cold pack.

U.S. Pat. No. 6,108,840 to Heimbrock, et al. discloses an apparatus for supporting a patient including a frame, a patient support deck coupled to the frame and configured to support the patient, and a head rest coupled to the patient-support deck and having longitudinally-extending, transversely spaced-apart sides. The head rest includes a pair of longitudinally-extending, transversely spaced-apart socket tubes adjacent to respective head rest sides. The head rest also includes a bottom plate extending transversely between the socket tubes and a side plate angling upwardly from each of the socket tubes so that a head cushion-receiving space is defined between the side plates. Each of the socket tubes has an interior region adapted to receive portions of a wrist rest assembly configured to be coupled to the head rest.

U.S. Pat. No. 6,182,313 to Eschenbach discloses a therapeutic head cradle apparatus having a pair of lateral side support members positioned to support the back, front or side of the head. Weight of the head will apply acupressure and shiatsu pressure to various pressure points located in the head area. Elastomeric cushion layers of different densities allow Chinese self-massage while the head is rolled side to side. A means to adjust the distance between the lateral support members is provided. Magnetic therapy and a sound system may also be part of the head cradle apparatus.

U.S. Pat. No. 6,484,336 to Berke, et al. discloses an ergonomic pillow for individuals who sleep on their sides. A characterizing feature of the invention is a recess along a lower front portion of the pillow which provides a protective space for a side, sleeper's arms. The pillow is divided into an upper portion and a lower portion which is set back from the upper portion to form the recess. Between the upper and lower portions is a flat planar member which distributes the loads of the side sleeper over the area of the lower pillow portion. In a first aspect of the invention, the protective recess extends across the front portion of the pillow. In further aspects, protective recesses are provided for the shoulders and arms of the side sleeper. A rear portion of the pillow is lowered for sleeping without a recess.

U.S. Pat. No. 7,080,420 to Damron discloses a head rest that includes a cushion and a support plate. The facial surface area that contacts the cushion is maximized by using a contoured upper surface for the cushion, a contoured upper surface for the support plate or a combination of both. The head rest also includes a holder for aroma therapy items and a relief mechanism for the occipital nerves.

U.S. Pat. No. 7,426,763 to Mazzei, et al. discloses a support for the head of a patient lying in a generally prone position. The support features a tray adapted for support on an underlying operating table surface. A plurality of pins projecting from an engagement with the tray are positioned to engage and suspend either a cushion directly or a cushion engaged in a casing. The pins may be adjusted to raise or lower the engaged cushion or casing. A mirror is also provided to view a patient's eyes through slots in the cushion and casing engaged over a patient's face.

U.S. Pat. No. 7,555,794 to Zelnik, et al. discloses methods and systems for medical imaging using an ergonomic patient head an arm support. A support for medical imaging is provided that includes a lower body configured to engage a portion of a medical imaging system and an upper surface having a plurality of depressions configured to receive therein at least one of a head and arm of a patient.

U.S. Pat. No. 7,640,609 to Roleder, et al. discloses a headrest assembly for supporting a face of a user of a massage device including a support frame and a resilient assembly. The support frame is coupled to the massage device. The resilient assembly includes a first resilient subassembly that is coupled to the support frame, and a second resilient subassembly that engages the first resilient subassembly. The first resilient subassembly and the second resilient subassembly cooperate and act in parallel to support the face of the user. The first resilient subassembly can include a plurality of spaced apart resilient members.

U.S. Pat. No. 7,673,356 to Conyers discloses a flexible tubular frame, comprising an upper section and a lower section, supporting a person's neck and head for hygienic, therapeutic, or cosmetic purposes. The upper section has a depressed portion shaped for supporting a person's neck when the person lies within the open ends of the base frame and the upper frame.

U.S. Pat. No. 7,788,749 to Ku discloses a foldable neck/waist support including a foldable board and a soft pad. The foldable board includes a central flat portion, a pair of inner oblique portions extending from two opposing sides of the central flat portion, a pair of outer oblique portions extending from the pair of inner oblique portions, a pair of insertion portions extending from the pair of outer oblique portions. The soft pad is a rectangular sheet to be stuck on the central flat portion and the pair of inner oblique portions with adhesive to form one piece. The soft pad has two opposing ends extending over the pair of inner oblique portions. An engaging slot is not coated with adhesive. When fording the present invention, top dents formed on the foldable board are bent rearward such that the outer oblique portions and the insertion portions are folded behind the central flat portion. When assembling the present invention, the top dents are pushed forward and inner dents and outer dents are pushed rearward. The insertion portions are folded backward along the outer dents. An engaging tab is inserted through the engaging slot and secured in place by a pair of hook-shaped notches. The gaps which are formed between each of the pair of support sections and the engaging tab provide a holding effect to form a pair of symmetrical hollow triangular prisms. The present invention can be used to support the neck or the waist of a user, and is light and compact for carrying with ease.

U.S. Pat. No. 7,938,491 to Montuore discloses a device, system, and method for a headrest. The headrest may have an orthopedic cervical support comprised of a semi-rigid polystyrene base and/or a memory foam or polyurethane foam covering for comfort. The curved shape of the headrest provides a full head support backing with two concave sides of equal proportion to support the head while turned as well as preventing a child or adult's head from tilting at an uncomfortable angle while at rest.

United States Patent Application 2003/0135927 to Hsia discloses an improved pillow consisting of a curved plate, a cushion having a thin middle portion and thick end portions and which may optionally consists of at least one inflatable air bag. A fabric encloses the cushion and the curved plate, and the curved plate optionally consists of at least two curved segment plates linked together by at least another curved plate. The improved pillow has an upper surface which has a valley in the center and a peak at each end.

United States Patent Application 2005/0066444 to Mazzei, et al. discloses a support for the head of a patient lying in a generally prone position. The support features a tray adapted for support on an underlying operating table surface. A plurality of pins projecting from an engagement with the tray are positioned to engage and suspend either a cushion directly or a cushion engaged in a casing. The pins may be adjusted to raise or lower the engaged cushion or casing. A mirror is also provided to view a patient's eyes through slots in the cushion and casing engaged over a patient's face.

United States Patent Application 2008/0271742 to Maginness discloses a head support having a body with a recess defined along a recess edge of the body to receive a person's lower jaw. A torso engaging edge of the body opposite the recess edge being formed to engage a portion of the person's torso when the person is sitting in a substantially upright position to prevent the recess from falling away from the person's lower jaw area.

United States Patent Application 2009/0025146 to Mazzeu, et al. discloses a support for the head of a patient lying in a generally prone position. The support features a tray adapted for support on an underlying operating table surface. A plurality of pins projecting from an engagement with the tray are positioned to engage and suspend either a cushion directly or a cushion engaged in a casing. The pins may be adjusted to raise or lower the engaged cushion or casing. A mirror is also provided to provide a reflective view a patient's eyes through slots in the cushion and casing engaged over a patient's face. A video camera may also concurrently be employed to capture electronic images of the patient's eyes and mouth through an aperture in the mirror.

Although the aforementioned prior art have contributed to the development of the art of cervical spine and head support, none of these prior art patents have solved the needs of this art.

Therefore, it is an object of the present invention to provide an improved apparatus for providing a user with cervical spine and head support.

Another object of this invention is to provide an improved apparatus for which may be retrofitted for use with existing cervical support pillows.

Another object of this invention is to provide an improved apparatus that is simple for the operator to use.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved head and neck support device for positioning about a neck of an individual. The neck joins a head with a torso of the individual. The torso has a first shoulder and a second shoulder. A generally U-shaped pillow encircles the neck and is positioned adjacent to the first shoulder and the second shoulder of the individual. The generally U-shaped pillow has a rear pillow section, a first leg section and a second leg section. The head and neck support device comprises a rear supporting panel, a primary supporting panel and a secondary supporting panel. The rear supporting panel has an interior surface, an exterior surface, an upper edge, a lower edge, a first side edge and a second side edge. The primary supporting panel has an interior surface, an exterior surface, an upper edge, a lower edge, a front side edge and a back side edge. The secondary supporting panel has an interior surface, an exterior surface, an upper edge, a lower edge, a front side edge and a back side edge. The first side edge of the rear supporting panel is secured to the back side edge of the primary supporting panel for defining a primary generally L-shaped frame. The second side edge of the rear supporting panel is secured to the back side edge of the secondary supporting panel for defining a secondary generally L-shaped frame. The primary generally L-shaped frame and the secondary generally L-shaped frame define a pillow enclosure frame and a pillow cavity. The pillow cavity receives the generally U-shaped pillow for positioning the interior surface of the primary supporting panel adjacent to the first leg section of the generally U-shaped pillow and positions the interior surface of the secondary supporting panel adjacent to the second leg section of the generally U-shaped pillow. The pillow enclosure frame encircles the generally U-shaped pillow for positioning the lower edge of the primary supporting panel adjacent to the first shoulder and the lower edge of the secondary supporting panel adjacent to the second shoulder. The primary supporting panel applies a first opposing force in an inward direction towards the neck of the individual upon the displacement of the head and neck from a vertical position towards the primary supporting panel for preventing displacement of the first leg section of the generally U-shaped pillow relative to the neck and supporting the head and neck in a generally vertical position. The secondary supporting panel applies a second opposing force in an inward direction towards the neck of the individual upon the displacement of the head and neck from a vertical position towards the secondary supporting panel for preventing displacement of the second leg section of the generally U-shaped pillow relative to the neck and supporting the head and neck in a generally vertical position.

In a more specific embodiment of the invention, a first hinge couples the first side edge of the rear supporting panel and the back side edge of the primary supporting panel for pivoting the primary supporting panel between the primary generally L-shaped frame and a first parallel orientation with the rear supporting panel. A second hinge couples the second side edge of the rear supporting panel and the back side edge of the secondary supporting panel for pivoting the secondary supporting panel between the secondary generally L-shaped frame and a second parallel orientation with the rear supporting panel.

In one embodiment of the invention, a generally U-shaped enclosure case has a rear enclosure section, a first leg enclosure section and a second leg enclosure section. A rear aperture is in the rear enclosure section for positioning the primary supporting panel, the secondary supporting panel, the rear supporting panel and the generally U-shaped pillow within the generally U-shaped enclosure case. The first leg enclosure section defines a first leg enclosure chamber for receiving and fastening the first leg section of the generally U-shaped pillow with the primary supporting panel. The second leg enclosure section defines a second leg enclosure chamber for receiving and fastening the second leg section of the generally U-shaped pillow with the secondary supporting panel. The rear enclosure section defines a rear enclosure chamber for receiving and fastening the rear pillow section of the generally U-shaped pillow with the rear supporting panel. A closure wall engages the rear enclosure section for covering the rear aperture in the rear enclosure section.

In another embodiment of the invention, a first leg groove traverses the exterior face of the first leg section. A second leg groove traverses the exterior face of the second leg section. A rear groove traverses the exterior face of the rear cushion section. The first leg groove, the second leg groove and the rear groove receive the primary supporting panel, the secondary supporting panel and the rear supporting panel respectively for interlocking the generally U-shaped cushion relative to the cushion enclosure frame.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

FIGS. 1-29A are various views of a head and neck support device 10. FIGS. 1-18A illustrate a first embodiment 12 of the head and neck support device 10. FIGS. 19-29A illustrate a second embodiment 14 of the head and neck support device 10.

Figure 1:
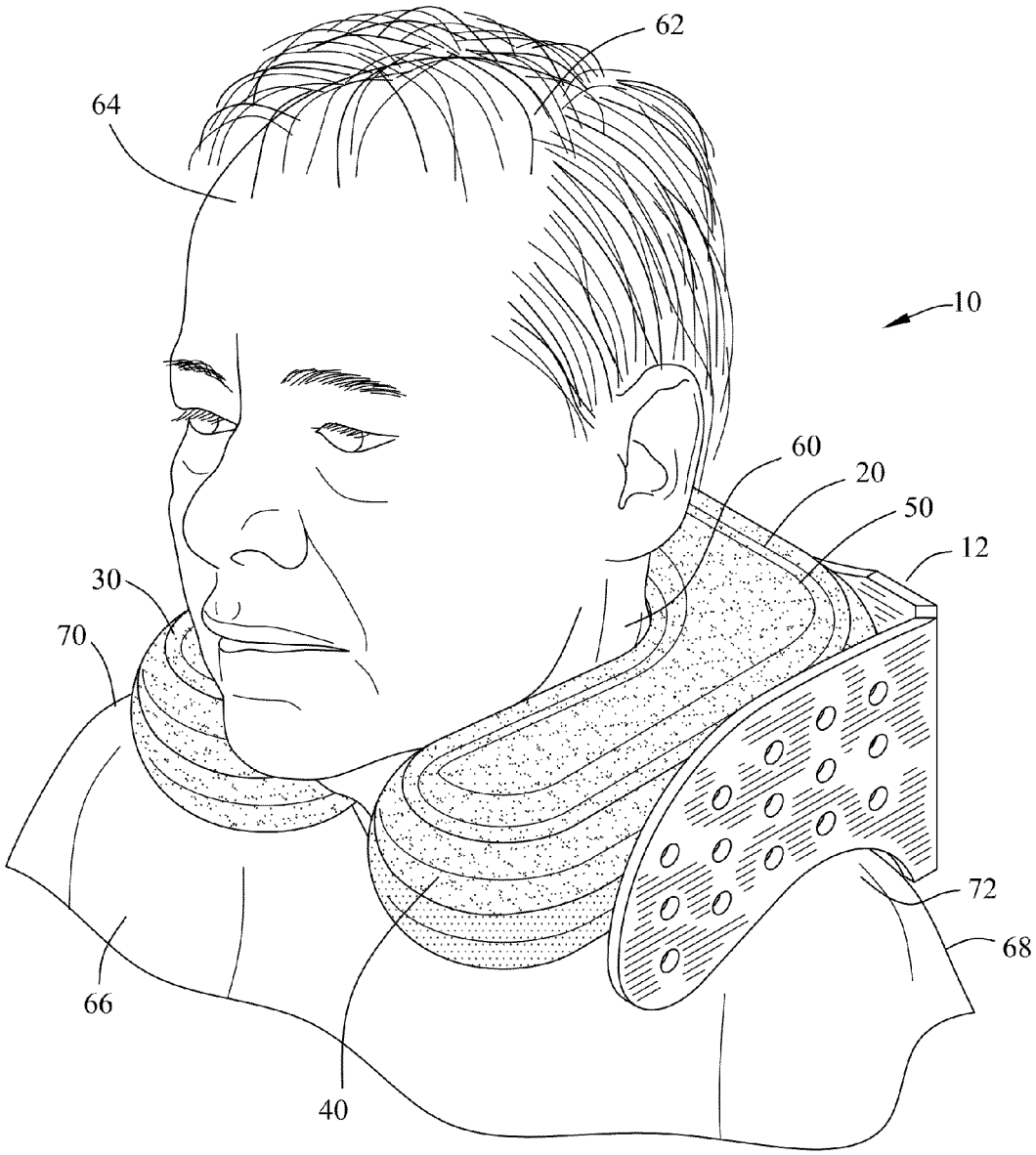
FIG. 1 is a front isometric view of a first embodiment of a head and neck support device encircling a generally U-shaped pillow positioned around a neck of an individual.
Figure 2:
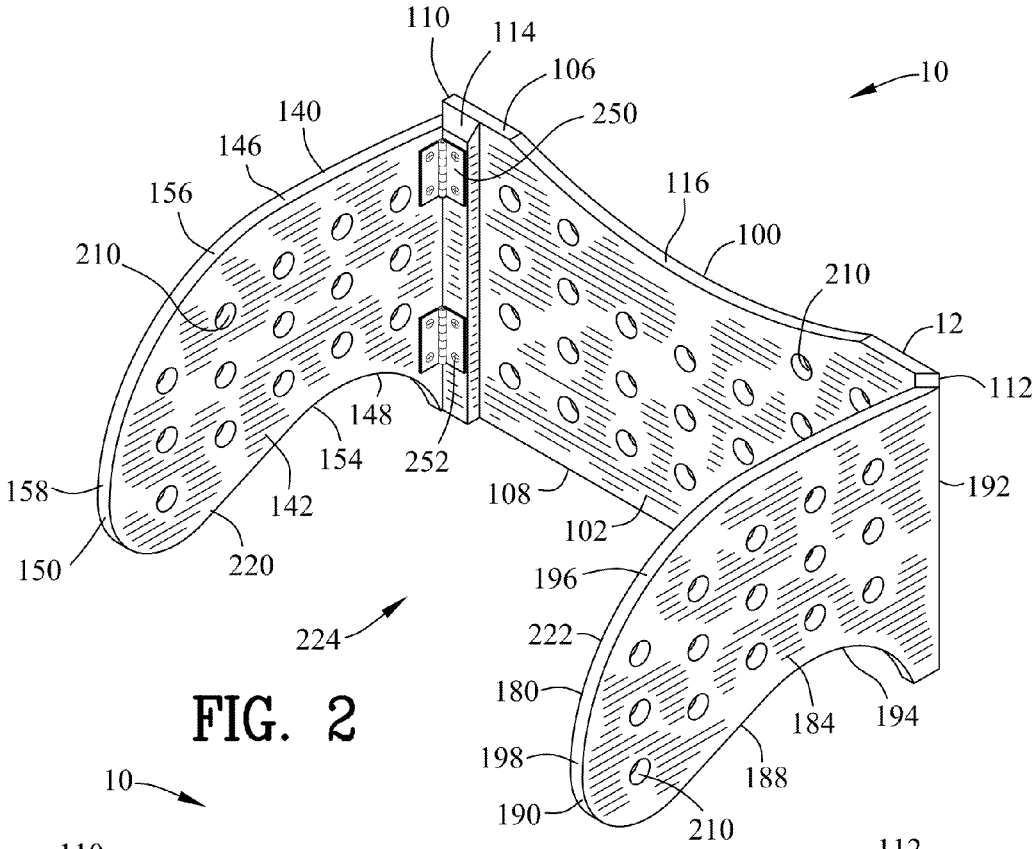
FIG. 2 is a similar view FIG. 1 illustrating the head and neck support device.
Figure 3:
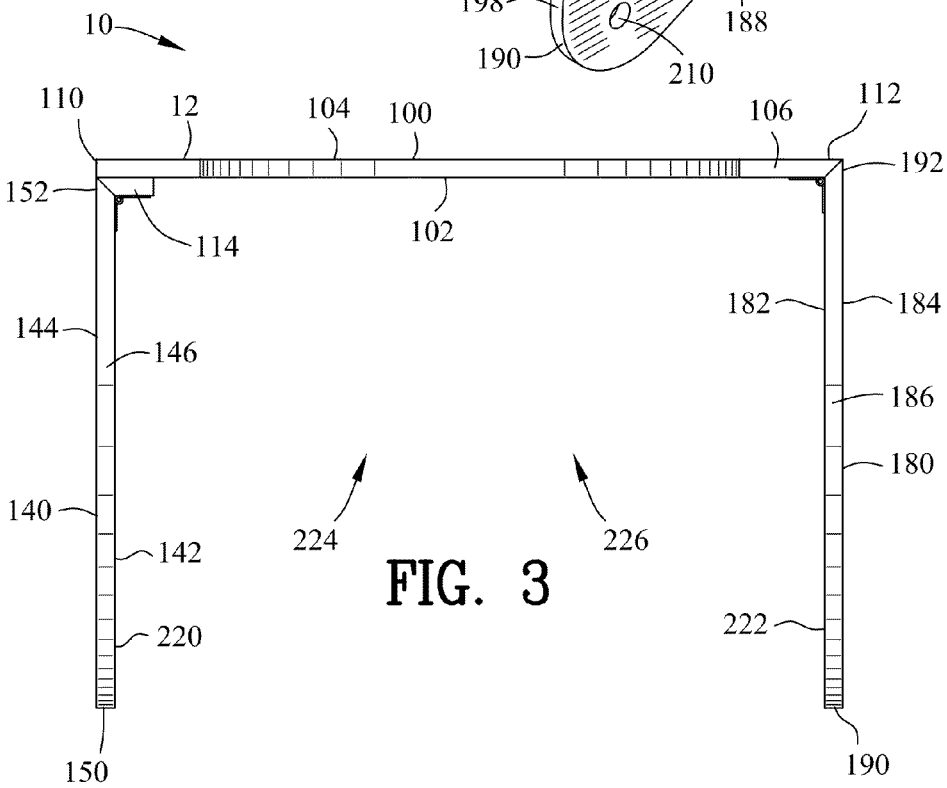
FIG. 3 is a top view of FIG. 2.
Figure 4:
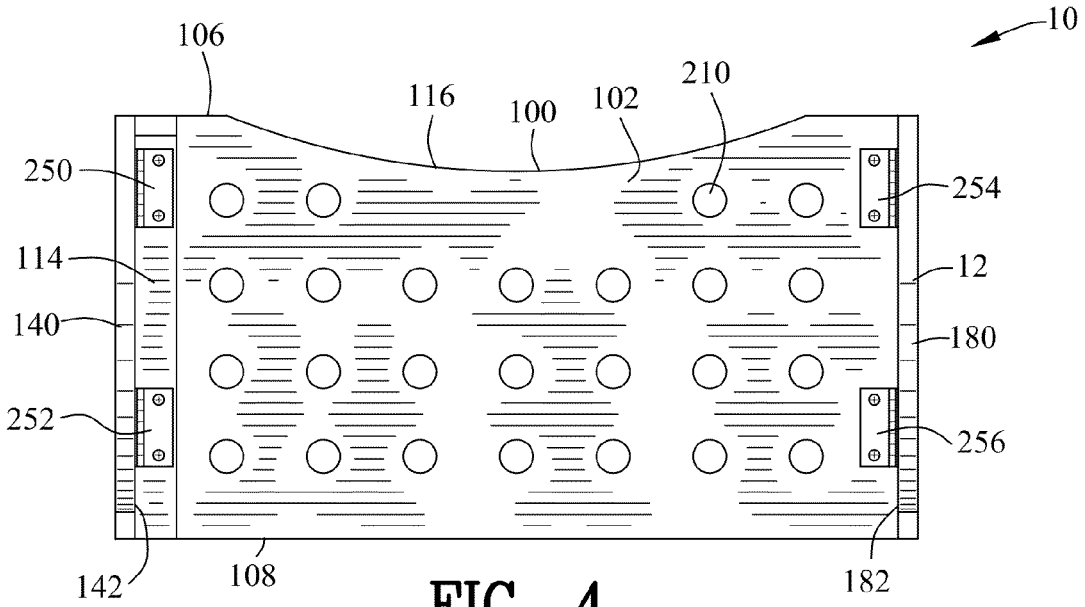
FIG. 4 is a front view of FIG. 2.
Figure 5:
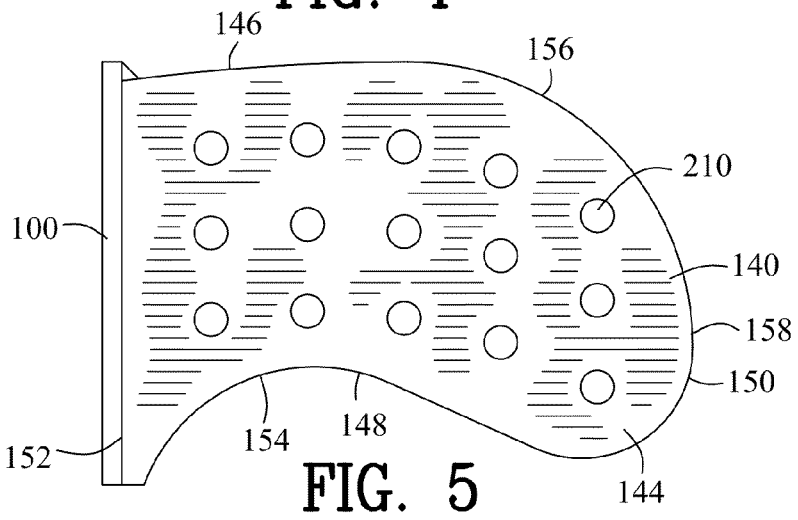
FIG. 5 is a left side view of FIG. 4.
Figure 6:
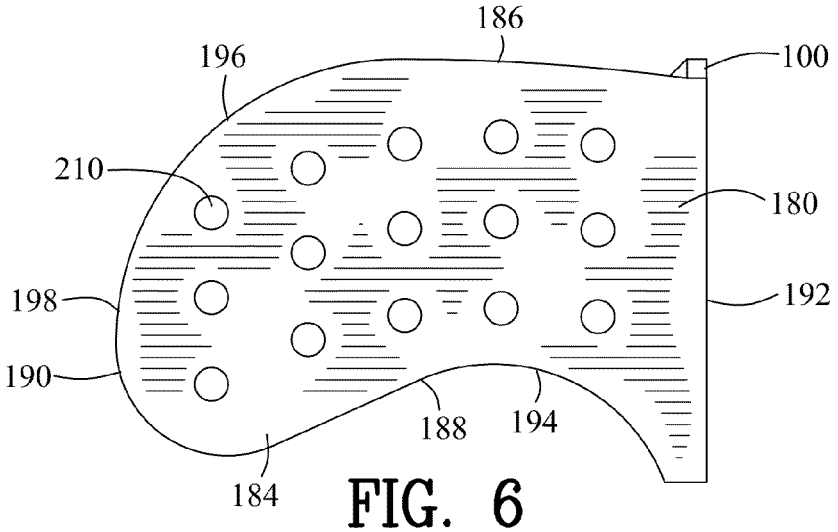
FIG. 6 is a right side view of FIG. 4.
Figure 7:
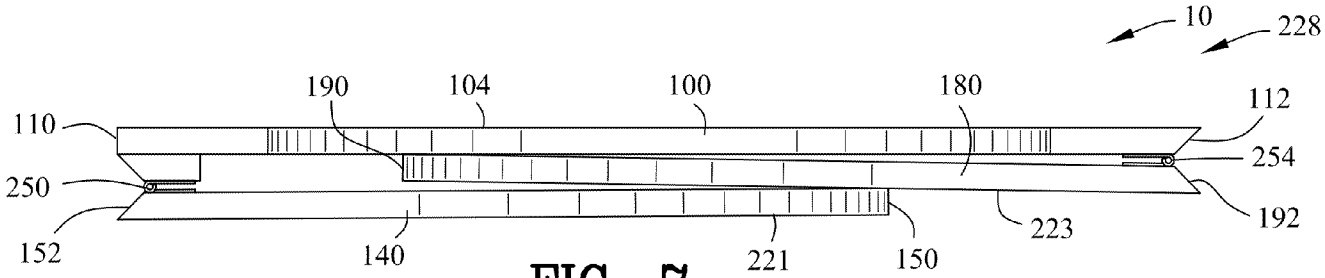
FIG. 7 is a view similar to FIG. 3 illustrating a first hinge and a second hinge positioning a primary supporting panel and a secondary supporting panel adjacent to a rear supporting panel.
Figure 8:
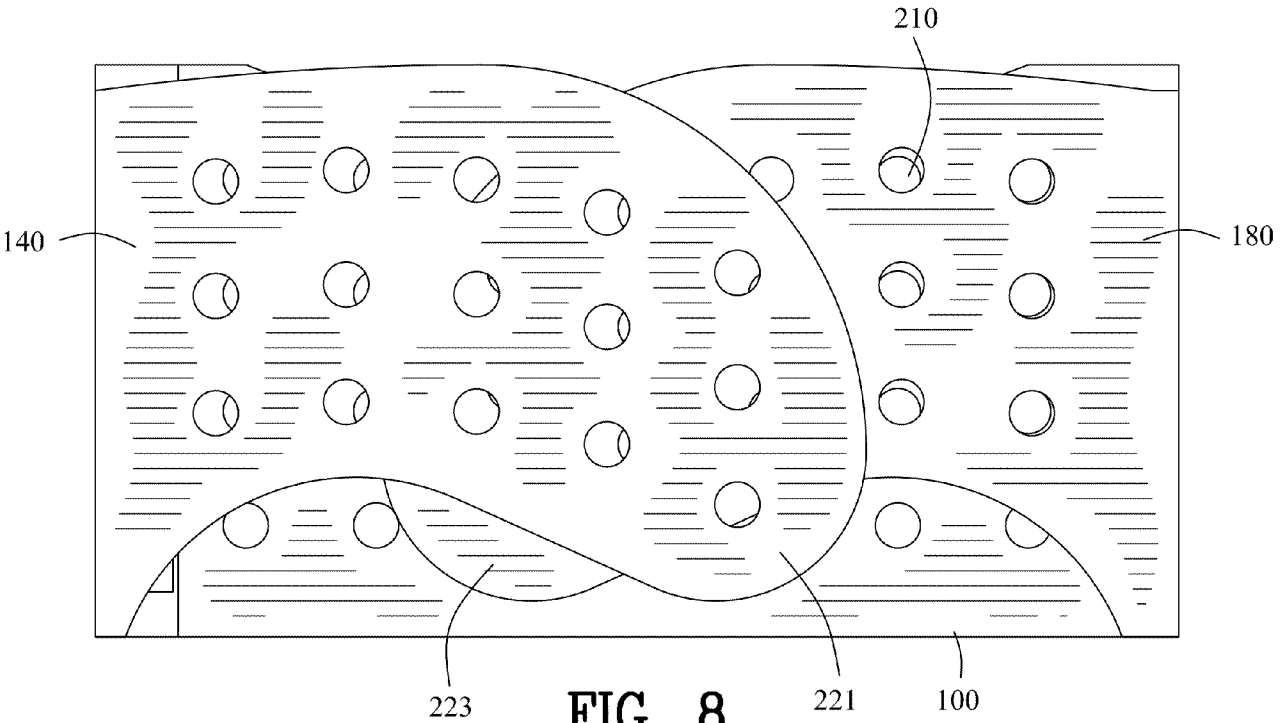
FIG. 8 is a front view of FIG. 7.
Figure 10:
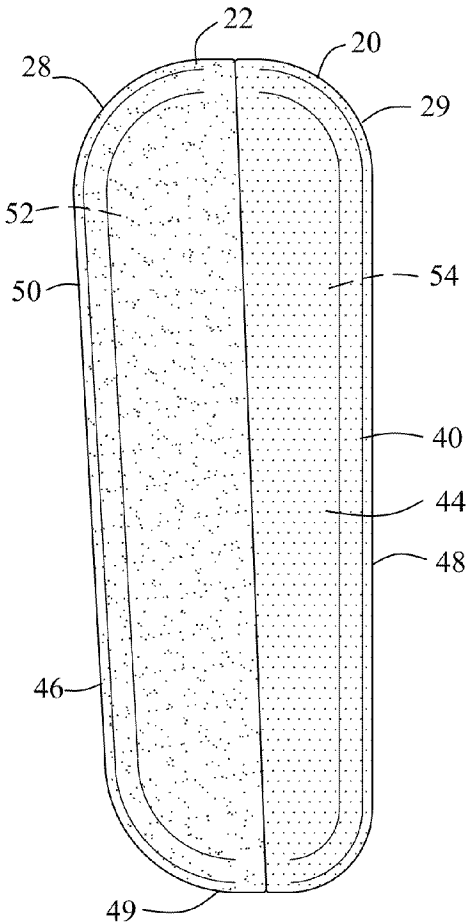
FIG. 10 PRIOR ART
FIG. 10 is a side of FIG. 9 illustrating prior art.
Figure 9:
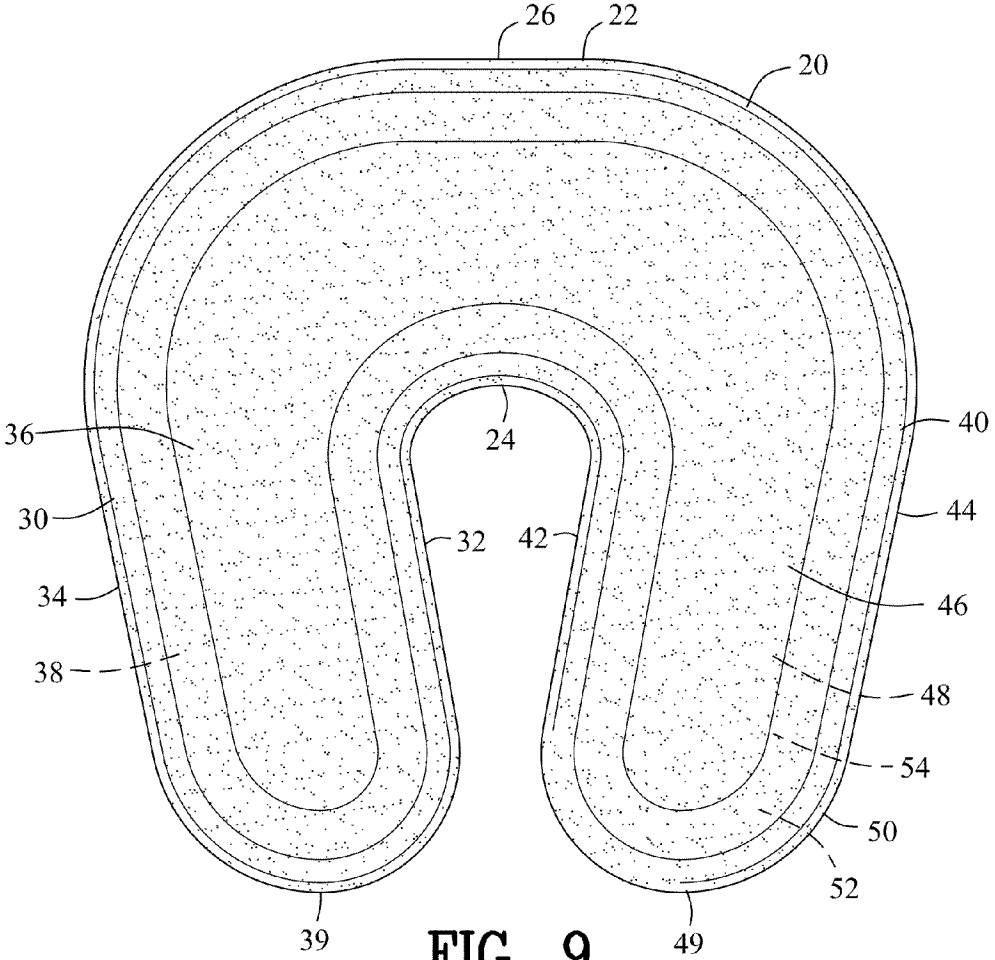
FIG. 9 is a top view of a generally U-shaped pillow illustrating prior art.

FIGS. 9 and 10 illustrate prior art including a generally U-shaped pillow 20. The generally U-shaped pillow 20 has a rear pillow section 22, a first leg section 30 and a second leg section 40. The rear pillow section 22 defines an interior wall 24, an exterior wall 26, an upper wall 28 and a lower wall 29. The first leg section 30 extends from the rear pillow section 22 and defines an interior wall 32, an exterior wall 34, an upper wall 36, a lower wall 38 and an end wall 39. Similarly, The second leg section 40 extends from the rear pillow section 22 and defines an interior wall 42, an exterior wall 44, an upper wall 46, a lower wall 48 and an end wall 49. Typically the generally U-shaped pillow 20 is constructed of a flexible fabric 50 that contains either a foam material 52 or a bead material 54.

Figure 16:
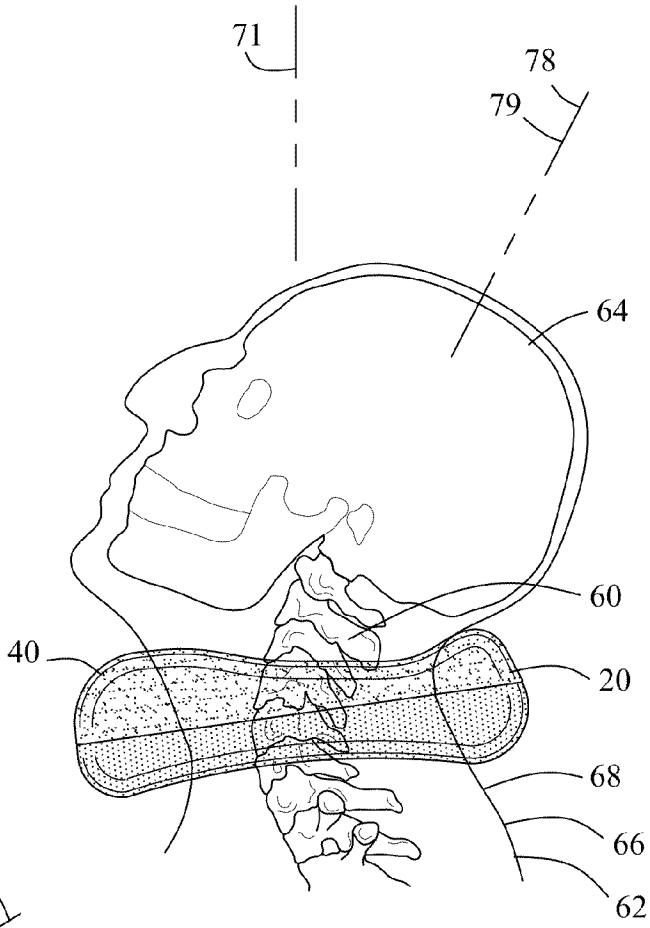
FIG. 16 is a side view of the generally U-shaped pillow positioned around a neck of an individual illustrating prior an with displacement of the head and neck from a vertical position towards the back of the individual.
Figure 15:
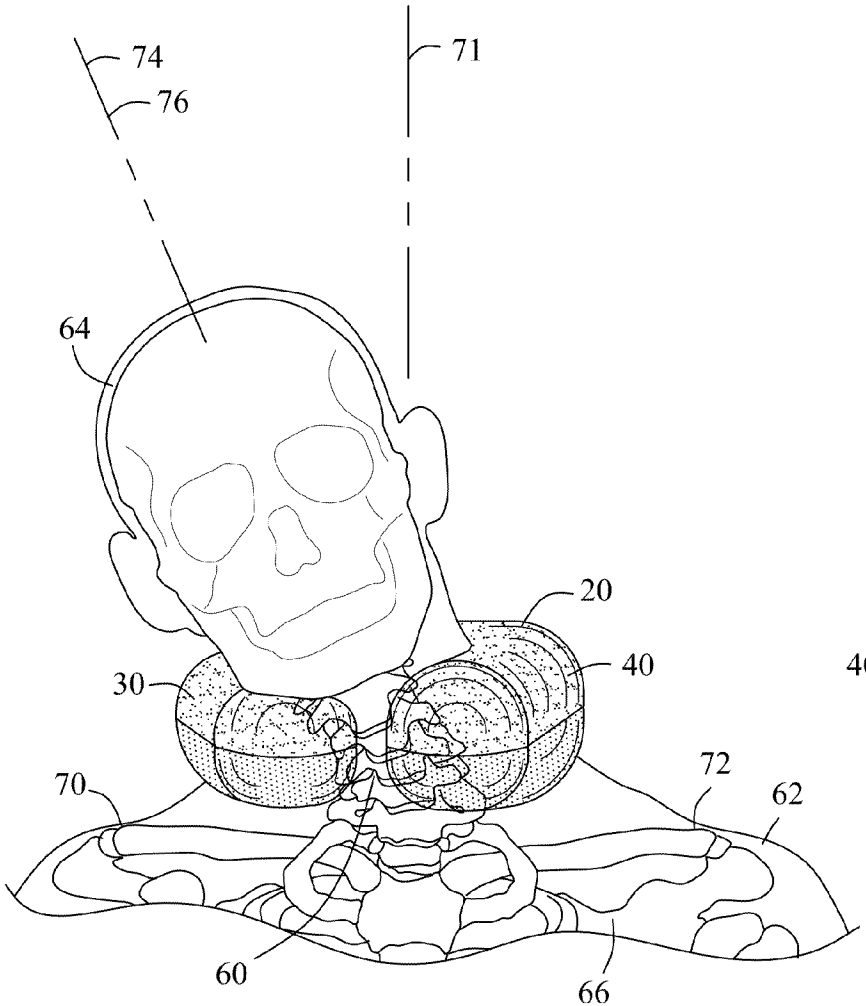
FIG. 15 is a front view of the generally U-shaped pillow positioned around a neck of an individual illustrating prior art with displacement of the head and neck from a vertical position towards the first shoulder of the individual.

As shown in FIGS. 15 and 16, the generally U-shaped pillow 20 has been utilized around the neck 60 of an individual 62. The neck 60 joins a head 64 with a torso 66 of the individual 62. The torso 66 has a first shoulder 70 and a second shoulder 72. The generally U-shaped pillow 20 encircles the neck 60 and is positioned adjacent to the first shoulder 70 and the second shoulder 72 of the individual 62. The generally U-shaped pillow 20 is intended to support the head 64 and neck 60 in a vertical orientation. However, upon a left or right lateral displacement 74 of the head 64 and neck 60 from a vertical position 71 as shown in FIG. 15, the generally U-shaped pillow 20 is compressed and or is displaced relative to the shoulders 70 and 72 of the individual 62 resulting in a first substantial angular displacement 76 of the head 64 and neck 60 relative to the upper torso 66 of the individual 62. Furthermore, upon a rear lateral displacement 78 of the head 64 and neck 60 from the vertical position 71 as shown in FIG. 16, the generally U-shaped pillow 20 is compressed and or is displaced relative to the shoulders 70 and 72 of the individual 62 resulting in a second substantial angular displacement 79 of the head 64 and neck 60 relative to the upper torso 66 of the individual 62.

As shown in FIGS. 1-18A, the head and neck support device 10 seeks to greatly improve the effectiveness of the generally U-shaped pillow 20 by limiting the compression and or displacement of the generally U-shaped pillow 20 relative to the shoulders 70 and 72 in order to reduce the angular displacements 76 and 79 of the head 64 and the neck 60 relative to the upper torso 66. The head and neck support device 10 of the first embodiment comprises a rear supporting panel 100, a primary supporting panel 140 and a secondary supporting panel 180.

The rear supporting panel 100 has an interior surface 102, an exterior surface 104, an upper edge 106, a lower edge 108, a first side edge 110 and a second side edge 112. The primary supporting panel 140 has an interior surface 142, an exterior surface 144, an upper edge 146, a lower edge 148, a front side edge 150 and a back side edge 152. The secondary supporting panel 180 has an interior surface 182, an exterior surface 184, an upper edge 186, a lower edge 188, a front side edge 190 and a back side edge 192.

The first side edge 110 of the rear supporting panel 100 is secured to the back side edge 152 of the primary supporting panel 140 for defining a primary generally L-shaped frame 220. The second side edge 112 of the rear supporting panel 100 is secured to the back side edge 192 of the secondary supporting panel 180 for defining a secondary generally L-shaped frame 222. The primary generally L-shaped frame 220 and the secondary generally L-shaped frame 222 define a pillow enclosure frame 224 and a pillow cavity 226. The rear supporting panel 100, primary supporting panel 140 and secondary supporting panel 180 may include a plurality of holes 210 for permitting ventilation into the pillow cavity 226.

As best shown in FIGS. 1, 12, 14, and 17-18A, the pillow cavity 226 receives the generally U-shaped pillow 20 for positioning the interior surface 142 of the primary supporting panel 140 adjacent to the first leg section 30 of the generally U-shaped pillow 20, positioning the interior surface 182 of the secondary supporting panel 180 adjacent to the second leg section 40 of the generally U-shaped pillow 20 and positioning the interior surface 102 of the rear supporting panel 100 adjacent to the rear pillow section 22 of the generally U-shaped pillow 20.

FIGS. 1 and 17-18A illustrate the pillow enclosure frame 224 encircling the generally U-shaped pillow 20 for positioning the lower edge 148 of the primary supporting panel 140 adjacent to the first shoulder 70 and the lower edge 188 of the secondary supporting panel 180 adjacent to the second shoulder 72.

The head and neck support device 10 limits the compression and or displacement of the generally U-shaped pillow 20 relative to the shoulders 70 and 72 and therefore reduces the angular displacements 76 and 79 of the head 64 and the neck 60 relative to the upper torso 66 by applying a plurality of forces 230 to the generally U-shaped pillow 20. In FIG. 17, the primary supporting panel 140 applies a first opposing force 232 in an inward direction towards the neck 60 of the individual 62 upon the displacement of the head 64 and neck 60 from the vertical position 71 towards the primary supporting panel 140 for preventing displacement of the first leg section 30 of the generally U-shaped pillow 20 relative to the neck 60 and supporting the head 64 and neck 60 in a generally vertical position 80. To assist the primary supporting panel 140 in FIG. 17, the secondary supporting panel 180 applies a third opposing force 234 in an outward direction away from the neck 60 of the individual 62 upon the displacement of the head 64 and neck 60 from the vertical position 71 towards the primary supporting panel 140 for preventing displacement of the first leg section 30 of the generally U-shaped pillow 20 relative to the neck 60 and supporting the head 64 and neck 60 is the generally vertical position 80.

Figure 17A:
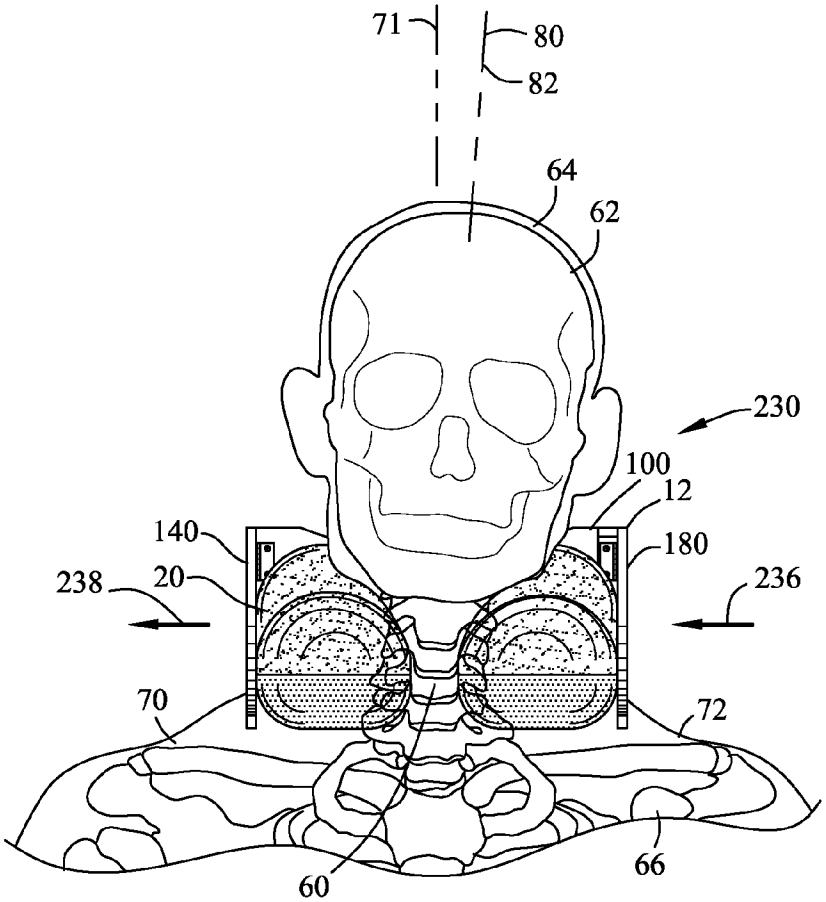
FIG. 17A is a front view of the generally U-shaped pillow positioned around a neck of an individual and with the head and neck support device encircling a generally U-shaped pillow and applying a second opposing force and a fourth opposing force for supporting the head and neck in a generally vertical position.
Figure 17:
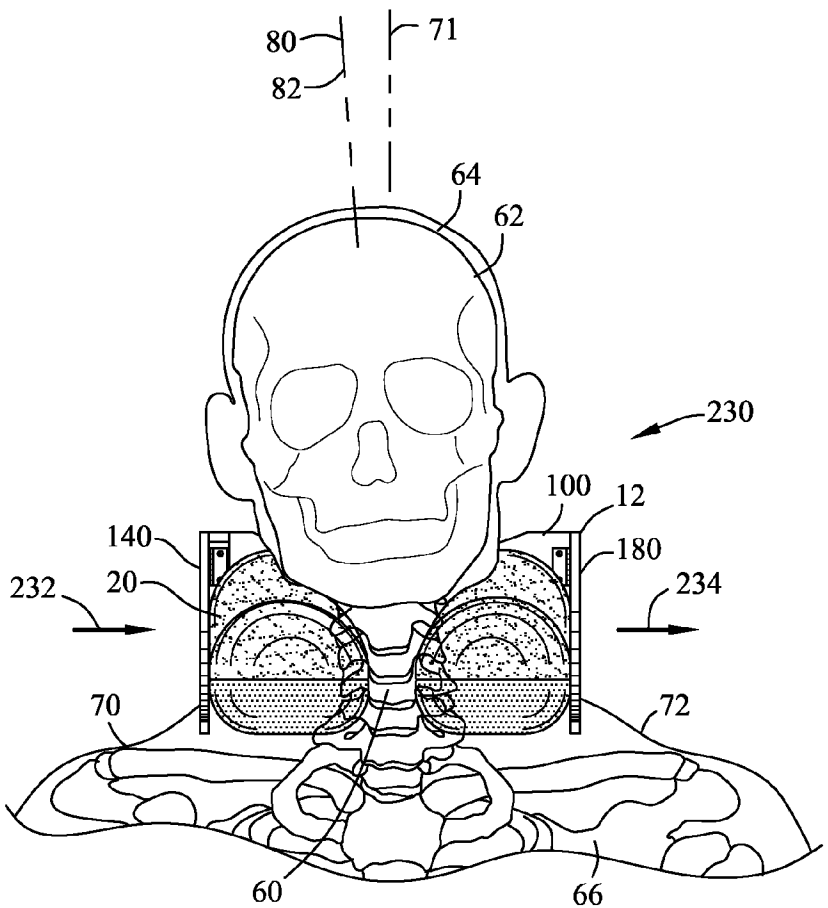
FIG. 17 is a front view of the generally U-shaped pillow positioned around a neck of an individual and with the head and neck support device encircling a generally U-shaped pillow and applying a first opposing force and a third opposing force for supporting the head and neck in a generally vertical position.

In FIG. 17A, the secondary supporting panel 180 applies a second opposing force 236 in an inward direction towards the neck 60 of the individual 62 upon the displacement of the head 64 and neck 60 from the vertical position 71 towards the secondary supporting panel 180 for preventing displacement of the second leg section 40 of the generally U-shaped pillow 20 relative to the neck 60 and supporting the head 64 and neck 60 is the generally vertical position 80. To assist the secondary supporting panel 180, the primary supporting panel 140 applies a fourth opposing force 238 in an outward direction away from the neck 60 of the individual 62 upon the displacement of the head 64 and neck 60 from the vertical position 71 towards the secondary supporting panel 180 for preventing displacement of the second leg section 40 of the generally U-shaped pillow 20 relative to the neck 60 and supporting the head 64 and neck 60 in the generally vertical position 80.

Figure 18A:
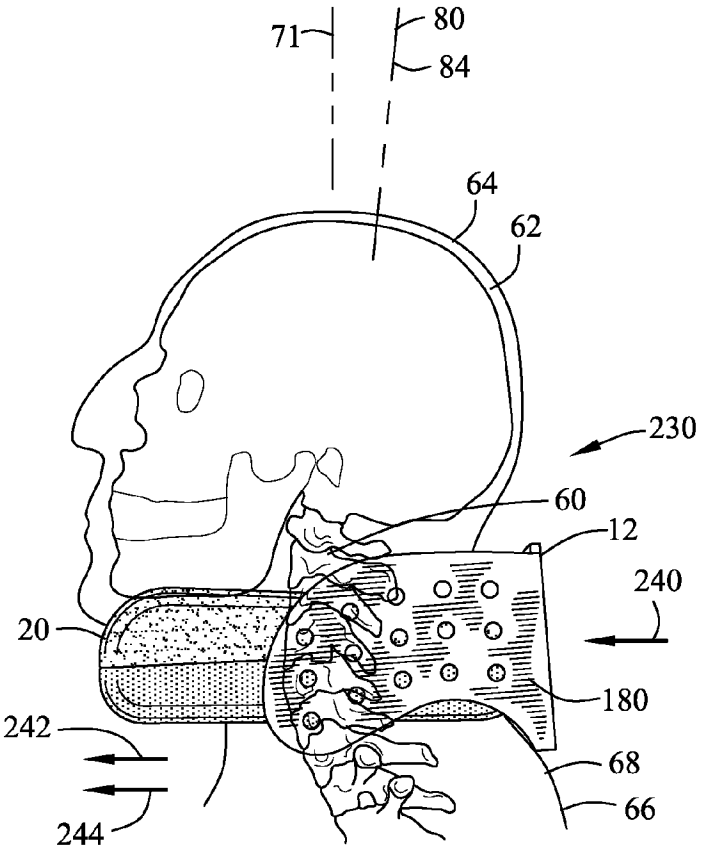
FIG. 18A is a side view of the generally U-shaped pillow positioned around a neck of an individual and with the head and neck support device encircling a generally U-shaped pillow and applying a fifth opposing force, a sixth opposing force and a seventh opposing force for supporting the head and neck in a generally vertical position.
Figure 18:
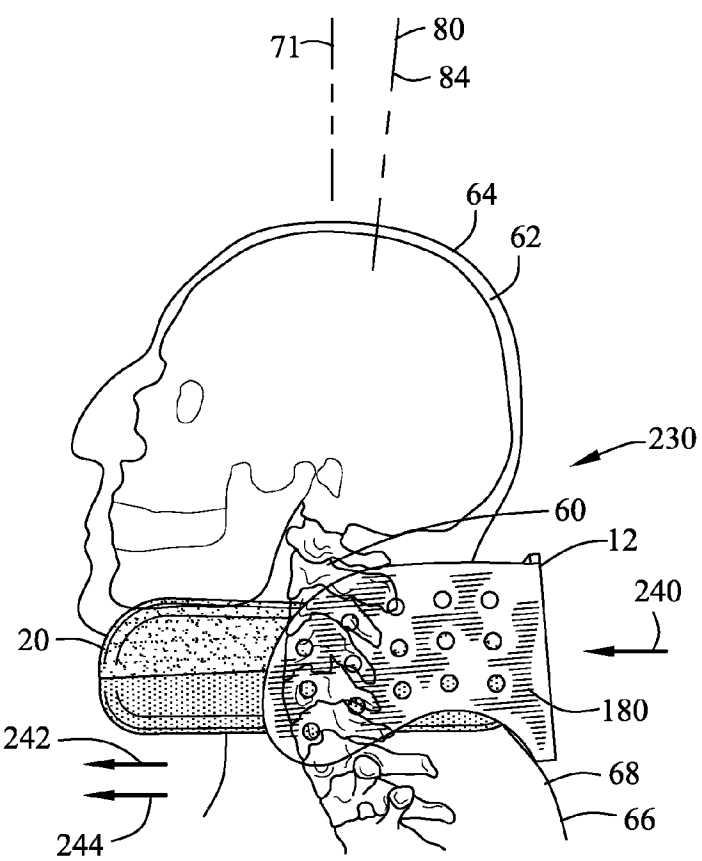
FIG. 18 is a side view of the generally U-shaped pillow positioned around a neck of an individual and with the head and neck support device encircling a generally U-shaped pillow and applying a fifth opposing force, a sixth opposing force and a seventh opposing force for supporting the head and neck in a generally vertical position.
Figure 19:
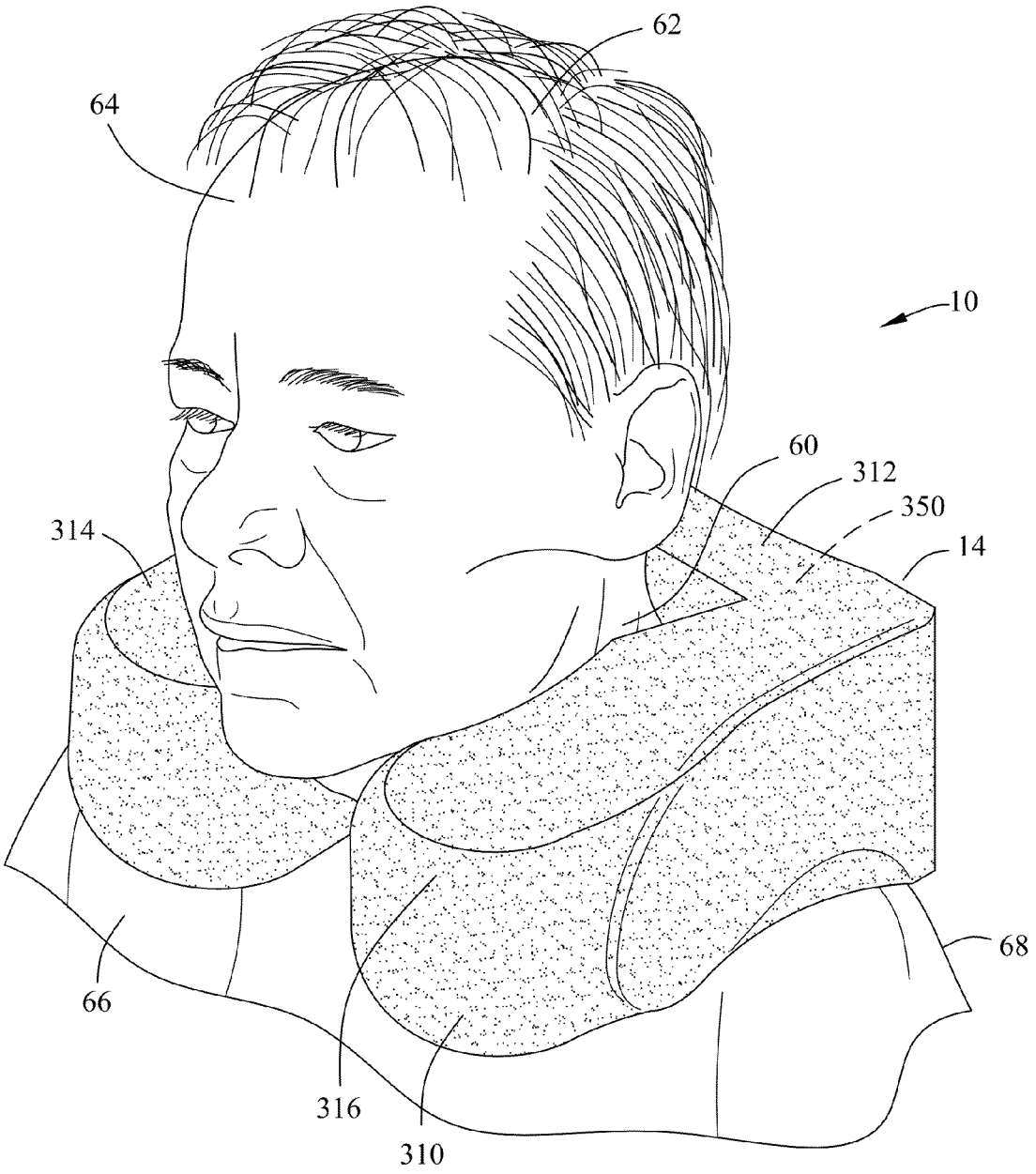
FIG. 19 is a front isometric view of a second embodiment of a head and neck support device encircling a neck of an individual.
Figure 20:
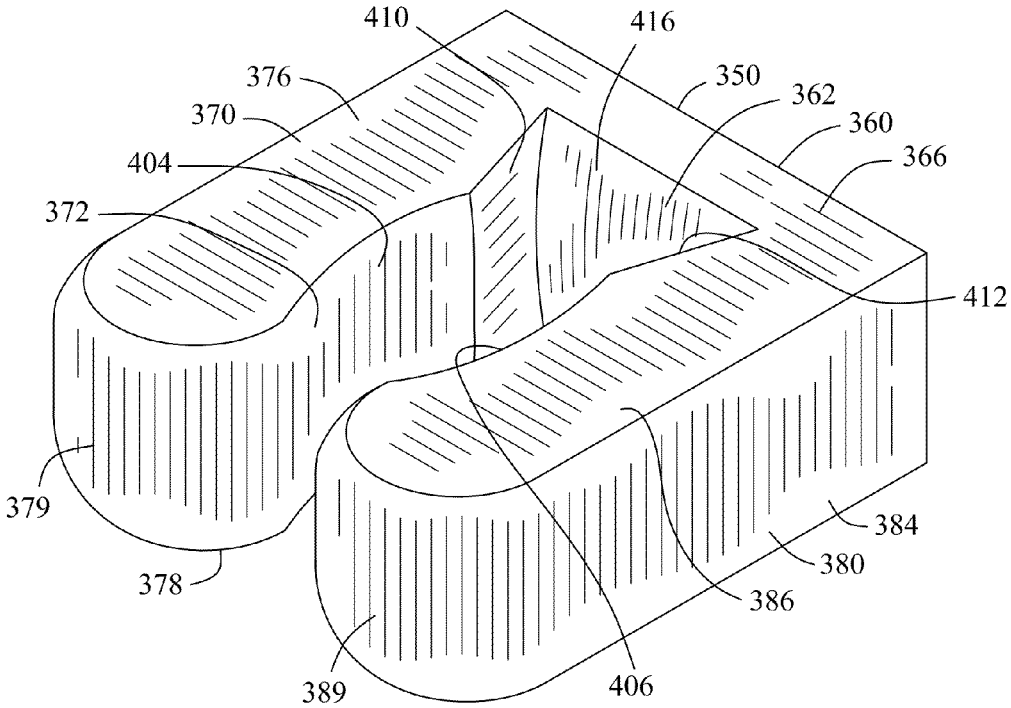
FIG. 20 is a front isometric view of a generally U-shaped cushion.
Figure 21:
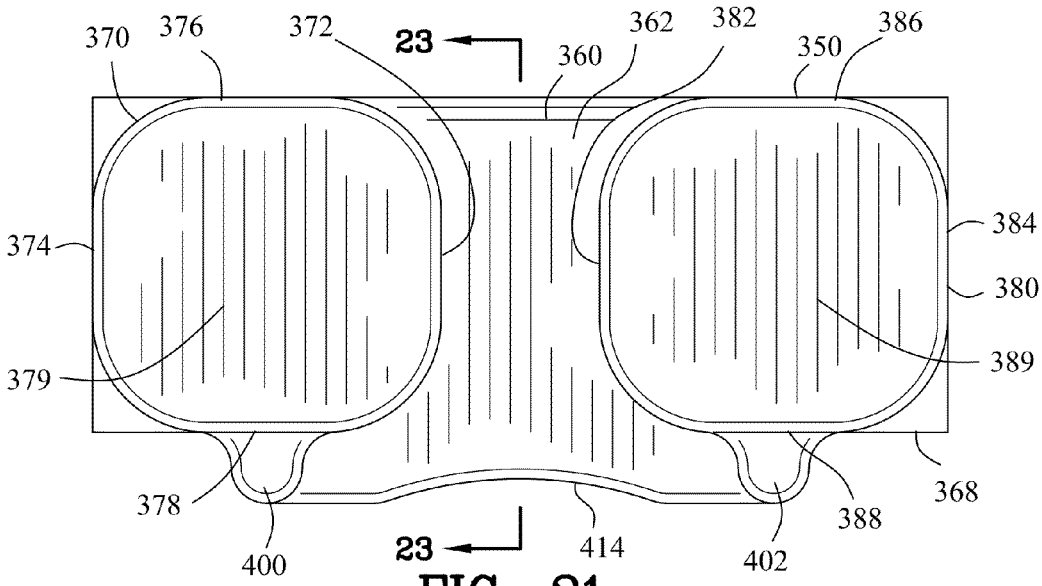
FIG. 21 is a front view of FIG. 20.
Figure 22:
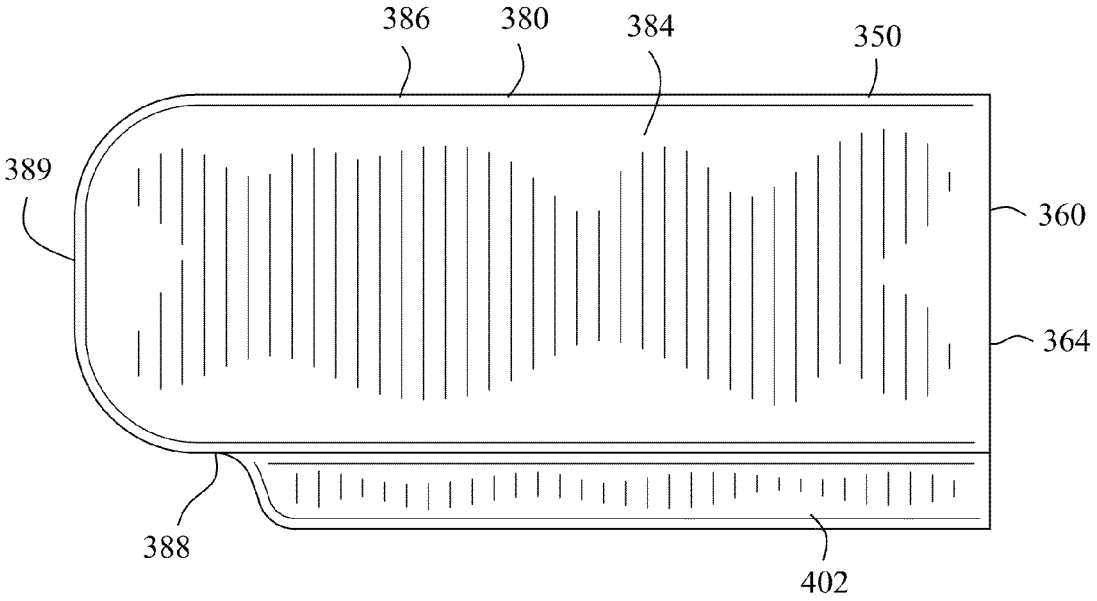
FIG. 22 is a right side view of FIG. 21.
Figure 23:
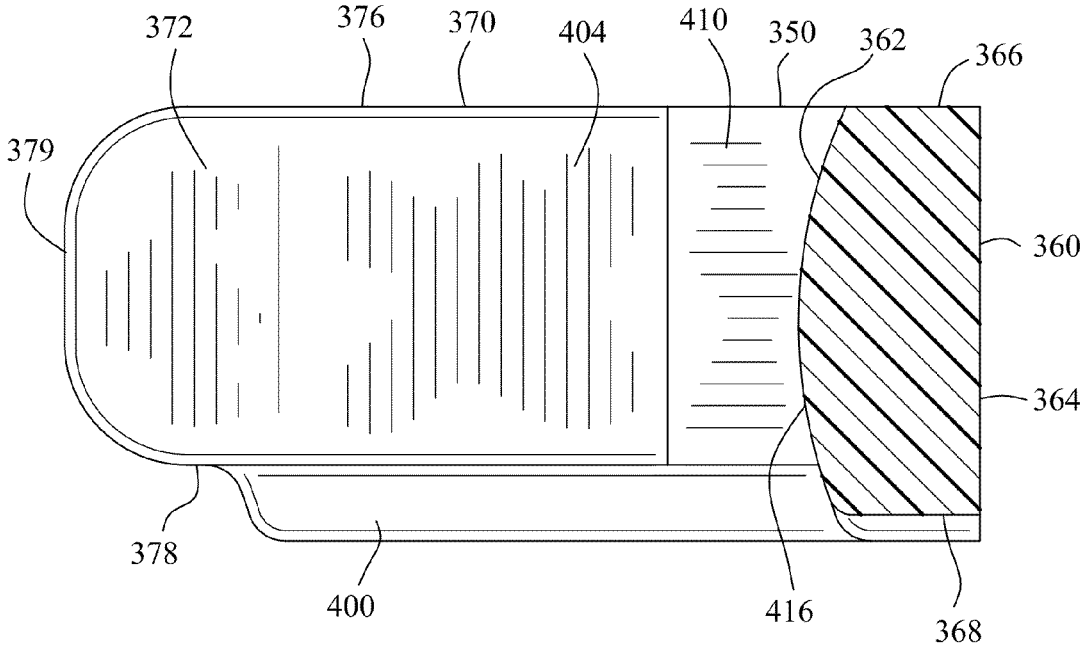
FIG. 23 is a sectional view along line 23-23 in FIG. 21.

In FIGS. 18 and 18A, the rear supporting panel 100 applies a fifth opposing force 240 in an inward direction towards the neck 60 of the individual 62 upon the displacement of the head 64 and neck 60 from the vertical position 71 towards the rear supporting panel 100 for preventing displacement of the rear pillow section 22 of the generally U-shaped pillow 20 relative to the neck 60 and supporting the head 64 and neck 60 in the generally vertical position 80.

Upon a left or right lateral displacement 74 of the head 64 and neck 60 from a vertical position 71 as shown in FIGS. 17 and 17A, the generally U-shaped pillow 20 is limited in its compression and or displacement relative to the shoulders 70 and 72 of the individual 62 resulting in a first reduced angular displacement 82 of the head 64 and neck 60 relative to the upper torso 66 of the individual 62. Furthermore, upon the rear lateral displacement 78 of the head 64 and neck 60 from the vertical position 71 as shown in FIGS. 18 and 18A, the generally U-shaped pillow 20 is limited in its compression and or displacement relative to the shoulders 70 and 72 of the individual 62 resulting in a second reduced angular displacement 84 of the head 64 and neck 60 relative to the upper torso 66 of the individual 62.

The rear supporting panel 100, the primary supporting panel 140 and the secondary supporting panel 180 may be constructed from an integral one piece unit. Alternatively, as shown in FIGS. 2-8, the primary supporting panel 140 may be pivotably coupled to the rear supporting panel 100 and the secondary supporting panel 180 may be pivotably coupled to the rear supporting panel 100. More specifically, a first hinge 250 and a third hinge 252 may couple the first side edge 110 of the rear supporting panel 100 and the back side edge 152 of the primary supporting panel 140 for pivoting the primary supporting panel 140 between the primary generally L-shaped frame 220 and a first parallel orientation 221 with the rear supporting panel 100. A second hinge 254 and a fourth hinge 256 may couple the second side edge 112 of the rear supporting panel 100 and the back side edge 192 of the secondary supporting panel 180 for pivoting the secondary supporting panel 180 between the secondary generally L-shaped frame 222 and a second parallel orientation 223 with the rear supporting panel 100.

The interior surface 102 of the rear supporting panel 100 may further include a stepping bar 114 that is positioned adjacent to the first side edge 110 of the rear supporting panel 100. The stepping bar 114 displaces the first hinge 250 and the third hinge 252 from the rear supporting panel 100 such that upon positioning the secondary supporting panel 180 into the second parallel orientation 223 and next positioning the primary supporting panel 140 into the first parallel orientation 221 will result in a overall parallel orientation 228 between the rear supporting panel 100, the primary supporting panel 140 and the secondary supporting panel 180.

As best shown in FIGS. 1, 2, 5, 11-14, 18 and 18A, the lower edge 148 of the primary supporting panel 140 includes a primary concave edge 154 for conforming to the first shoulder 70 of the individual 62. The lower edge 188 of the secondary supporting panel 180 includes a secondary concave edge 194 for conforming to the second shoulder 72 of the individual 62. The primary concave edge 154 of the primary supporting panel 140 permits the primary supporting panel 140 to assists the rear supporting panel 100 by applying a sixth opposing force 242 in an outward direction away from the neck 60 of the individual 62 upon the displacement of the head 64 and neck 60 from the vertical position 71 towards the rear supporting panel 100 for preventing displacement of the rear pillow section 22 of the generally U-shaped pillow 20 relative to the neck 60 and supporting the head 64 and neck 60 in the generally vertical position 80.

Similarly, secondary concave edge 194 of the secondary supporting panel 180 permits the secondary supporting panel 180 to assists the rear supporting panel 100 by applying applies a seventh opposing force 244 in an outward direction away from the neck 60 of the individual 62 upon the displacement of the head 64 and neck 60 from the vertical position 71 towards the rear supporting panel 100 for preventing displacement of the rear pillow section 22 of the generally U-shaped pillow 20 relative to the neck 60 and supporting the head 64 and neck 60 in the generally vertical position 80.

The upper edge 146 of the primary supporting panel 140 may include a primary arc edge 156 for conforming to the head 64 of the individual 62. The upper edge 186 of the secondary supporting panel 180 may include a secondary arc edge 196 for conforming to the head 64 of the individual 62. The front side edge 150 of the primary supporting panel 140 may include a primary convex edge 158 for conforming to the first shoulder 70 and the head 64 of the individual 62. The front side edge 190 of the secondary supporting panel 10 may include a secondary convex edge 198 for conforming to the second shoulder 72 and head 64 of the individual 62. The upper edge 106 of the rear supporting panel 100 includes a rear concave edge 116 for conforming to the head 64 of the individual 62.

Figure 11:
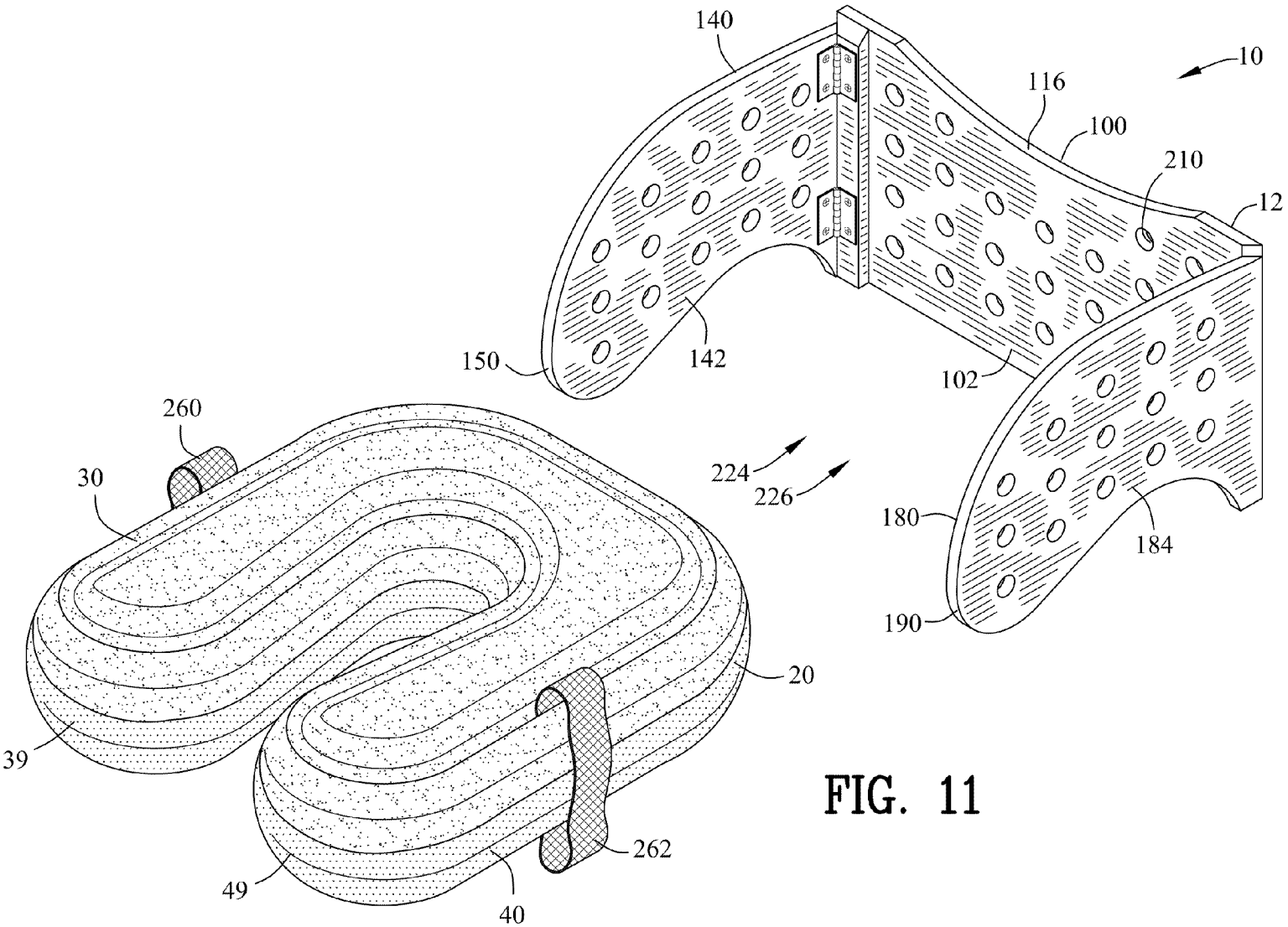
FIG. 11 is a view similar of FIG. 2 illustrating the generally U-shaped pillow having a first elastic band and a second elastic band.
Figure 12:
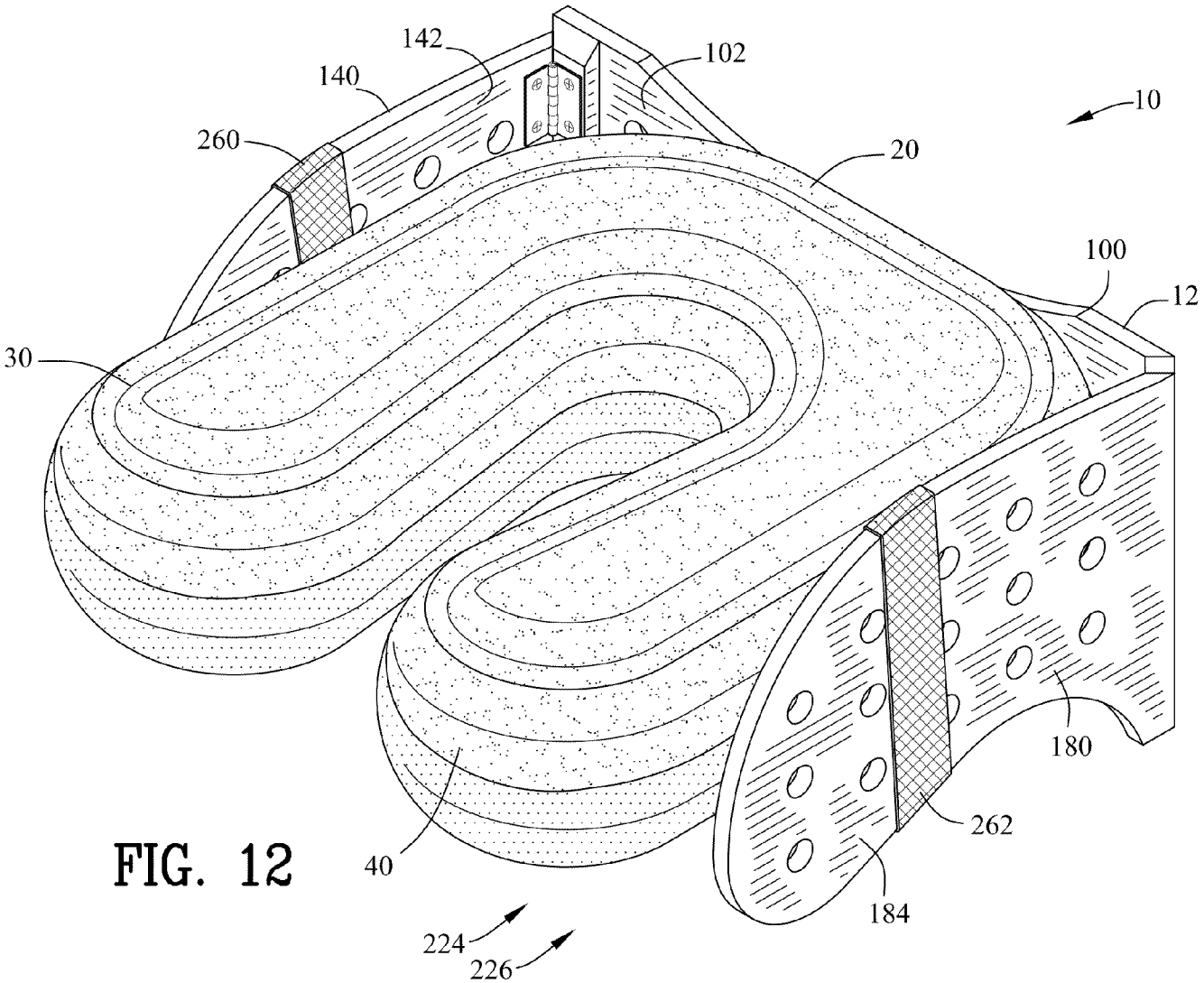
FIG. 12 is a similar view of FIG. 11 illustrating the first elastic band expanding around the primary supporting panel and the second elastic band expanding around the secondary supporting panel.

FIGS. 11-14 and 24, illustrate various structures for fastening the generally U-shaped pillow 20 with the head and neck support device 10. FIGS. 11 and 12 illustrate a first elastic band 260 secured to the first leg section 30 of the generally U-shaped pillow 20. The first elastic band 260 expands around the primary supporting panel 140 for fastening the first leg section 30 of the generally U-shaped pillow 20 with the primary supporting panel 140. A second elastic band 262 is secured to the second leg section 40 of the generally U-shaped pillow 20. The second elastic band 262 expands around the secondary supporting panel 180 for fastening the second leg section 40 of the generally U-shaped pillow 20 with the secondary supporting panel 180.

Figure 13:
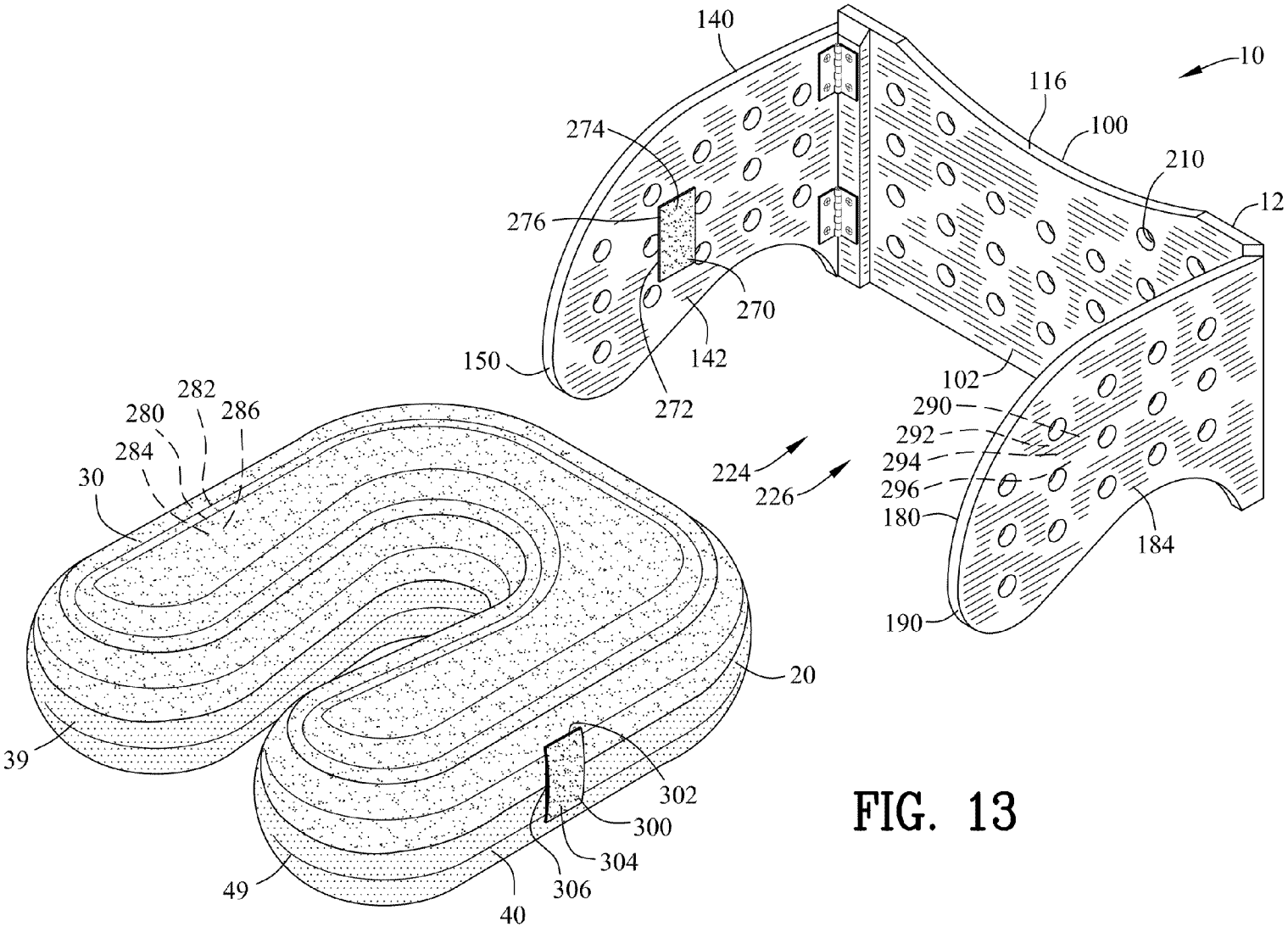
FIG. 13 is a view similar of FIG. 2 illustrating a first sheet coupled to the primary supporting panel, a second sheet coupled to a first leg section of the generally U-shaped pillow, a third sheet coupled to the secondary supporting panel, a fourth sheet coupled to a second leg section of the generally U-shaped pillow.
Figure 14:
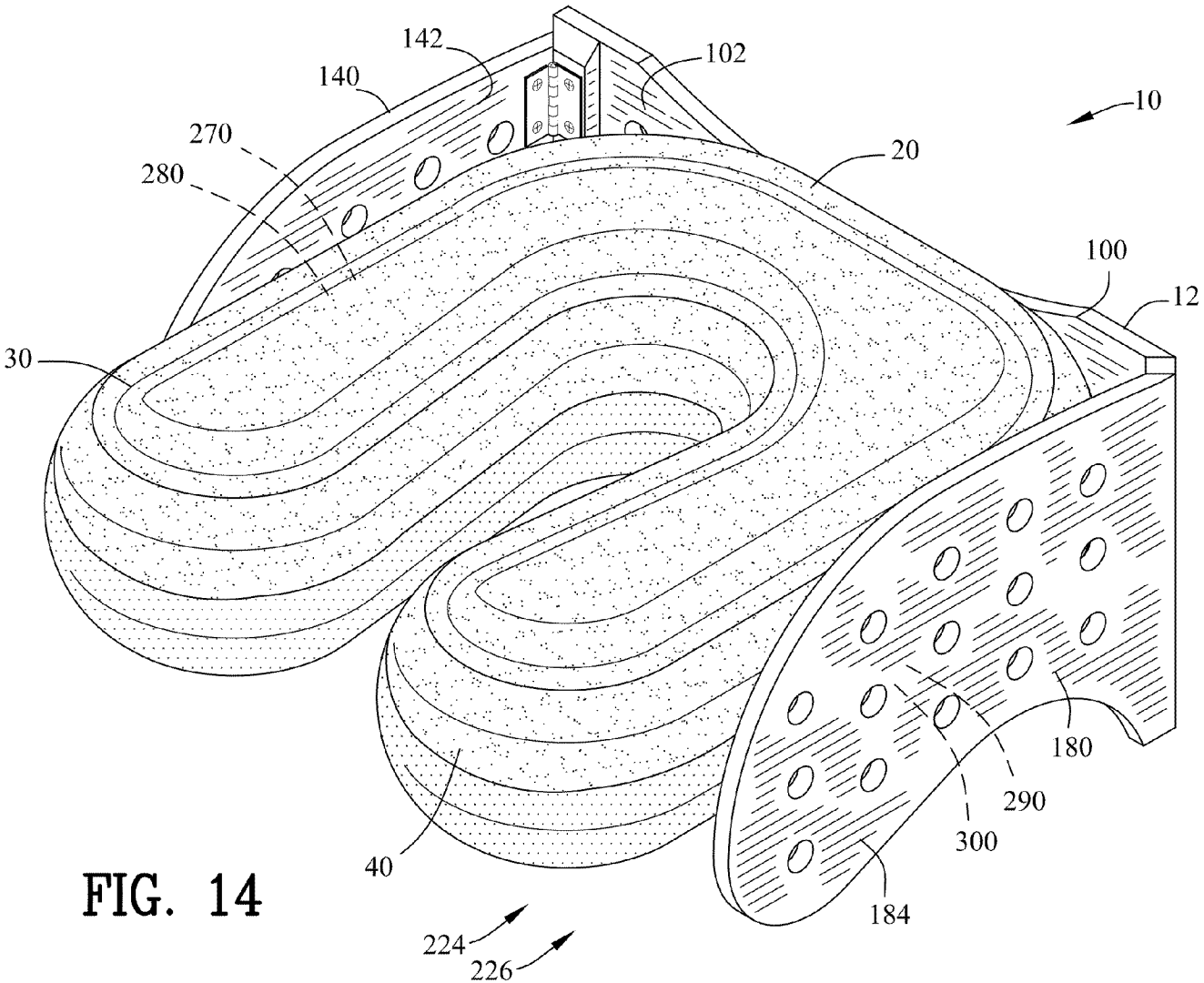
FIG. 14 is a similar view of FIG. 13 illustrating the first sheet coupled with the second sheet and the third sheet coupled to the fourth sheet.

FIGS. 13 and 14 illustrate a first sheet 270 having a bottom surface 272 and a loop top surface 274. A first sheet coupling 276 secures the bottom surface 272 of the first sheet 270 to the interior surface 142 of the primary supporting panel 140. A second sheet 280 has a bottom surface 282 and a hook top surface 284. A second sheet coupling 286 secures the bottom surface 282 of the second sheet 280 to the first leg section 30 of the generally U-shaped pillow 20. The loop top surface 274 of the first sheet 270 engages the hook top surface 284 of the second sheet 280 for fastening the first leg section 30 of the generally U-shaped pillow 20 with the primary supporting panel 140.

A third sheet 290 has a bottom surface 292 and a loop top surface 294. A third sheet coupling 296 secures the bottom surface 292 of the third sheet 290 to the interior surface 182 of the secondary supporting pane 1801. A fourth sheet 300 has a bottom surface 302 and a hook top surface 304. A fourth sheet coupling 306 secures the bottom surface 302 of the fourth sheet 300 to the second leg section 40 of the generally U-shaped pillow 20. The loop top surface 294 of the third sheet 290 engages the hook top surface 304 of the fourth sheet 300 for fastening the second leg section 40 of the generally U-shaped pillow 20 with the secondary supporting panel 180. The first sheet coupling 276, the second sheet coupling 286, the third sheet coupling 296 and the fourth sheet coupling 306 may include an adhesive, stitching or other fastening methods.

Figure 24:
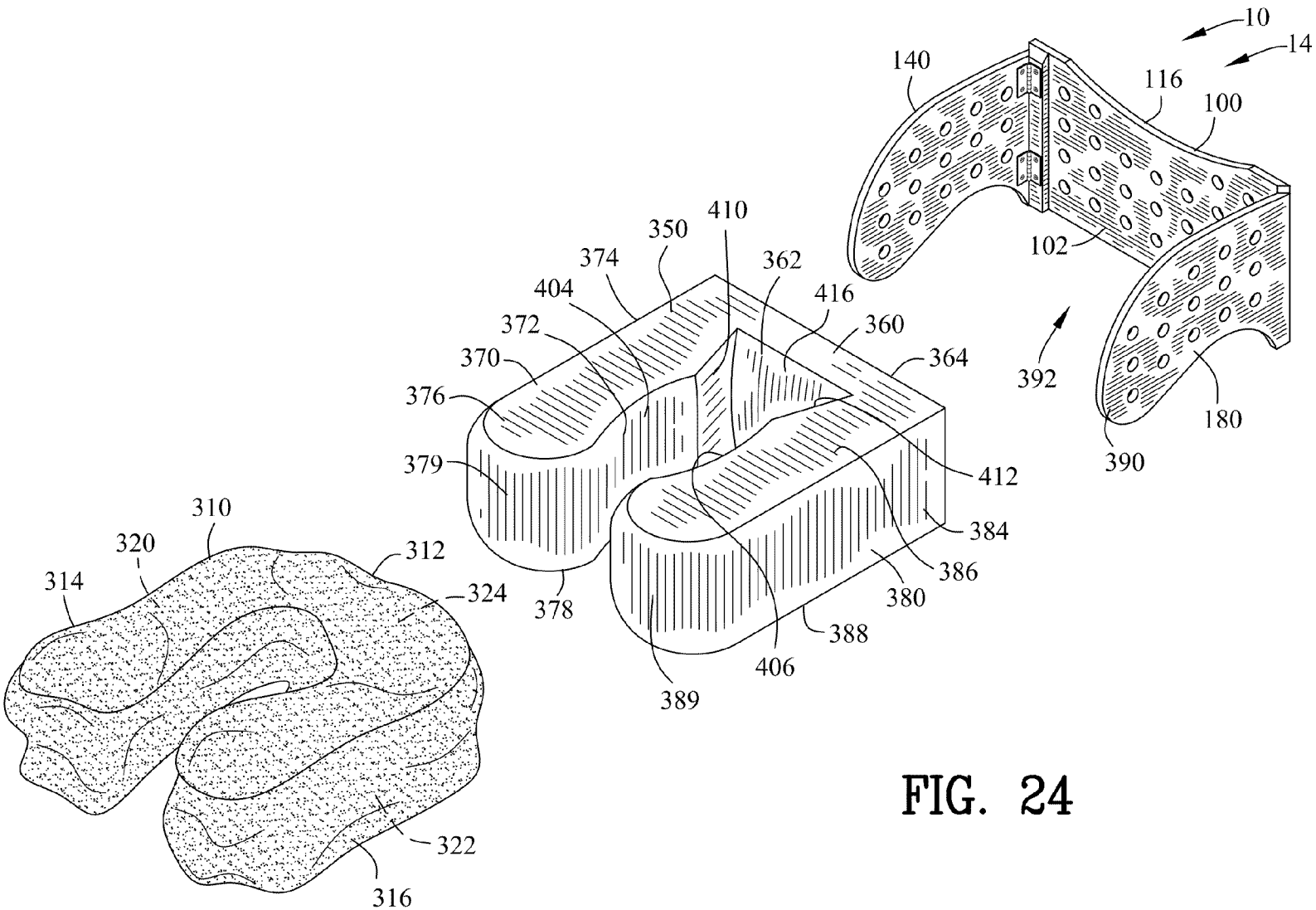
FIG. 24 is an exploded isometric view of the second embodiment of the head and neck support device of FIG. 19.
Figure 25:
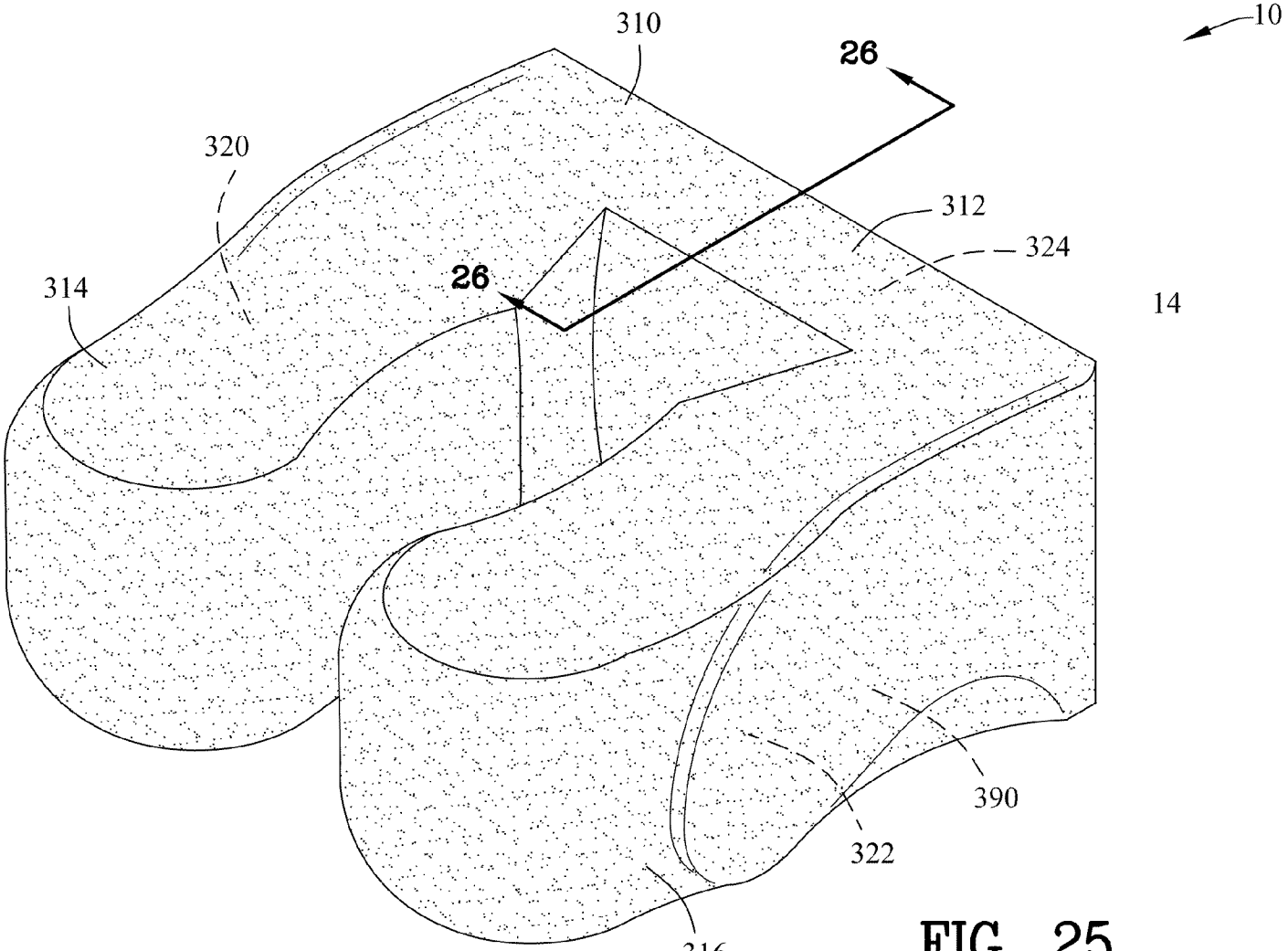
FIG. 25 is an isometric view of the second embodiment of the head and neck support device of FIG. 24 assembled.
Figure 27:
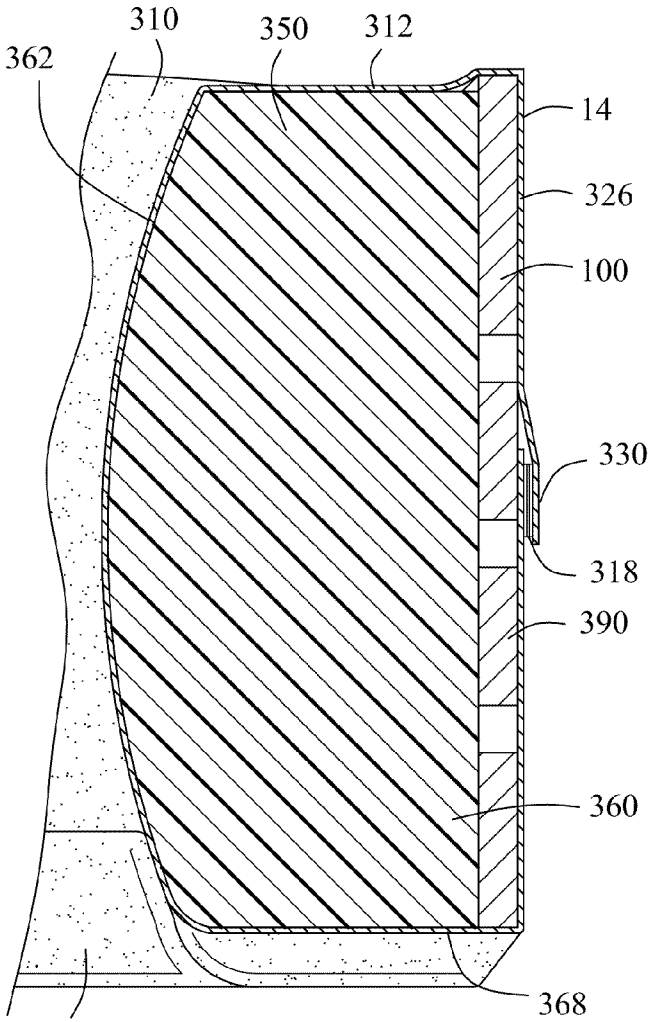
FIG. 27 is a sectional view along line 26-26 in FIG. 26 illustrating a second fastener including a hook strip and a loop strip.
Figure 26:
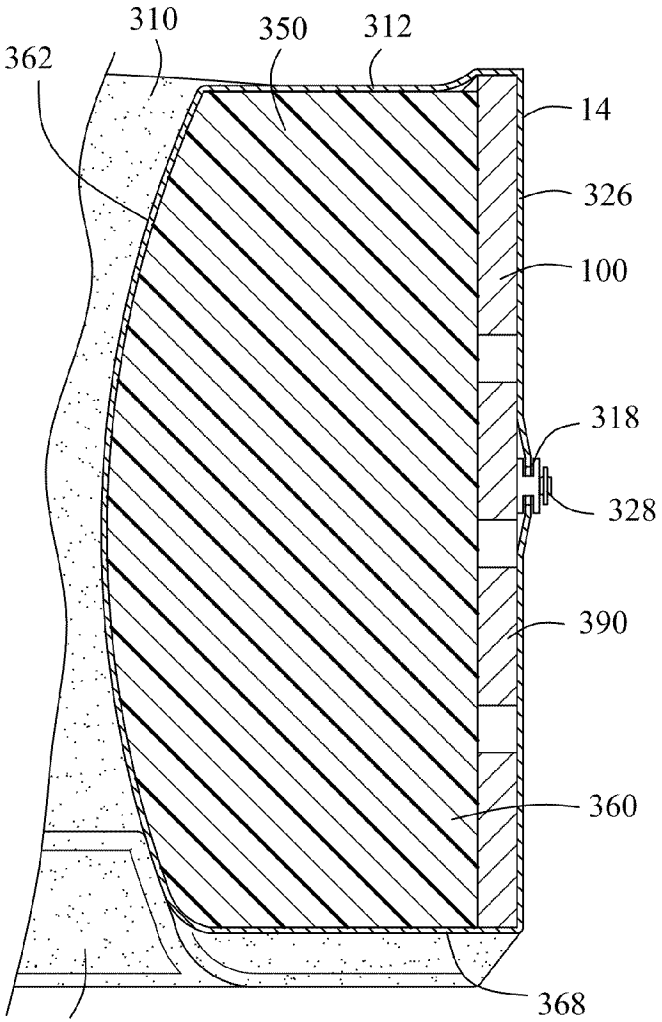
FIG. 26 is a sectional view along line 26-26 in FIG. 26 illustrating a first fastener including a zipper.

FIG. 24 illustrates a generally U-shaped enclosure case 310 for encasing both the generally U-shaped pillow 20 and the head and neck support device 10 and retaining the generally U-shaped pillow 20 against the head and neck support device 10. The generally U-shaped enclosure case 310 has a rear enclosure section 312, a first leg enclosure section 314 and a second leg enclosure section 316. A rear aperture 318 is in the rear enclosure section 312 for positioning the primary supporting panel 140, the secondary supporting panel 180, the rear supporting panel 100 and the generally U-shaped pillow 20 within the generally U-shaped enclosure case 310. The first leg enclosure section 314 defines a first leg enclosure chamber 320 for receiving and fastening the first leg section 30 of the generally U-shaped pillow 20 with the primary supporting panel 140. The second leg enclosure section 316 defines a second leg enclosure chamber 322 for receiving and fastening the second leg section 40 of the generally U-shaped pillow 20 with the secondary supporting panel 180. The rear enclosure section 312 defines a rear enclosure chamber 324 for receiving and fastening the rear pillow section 22 of the generally U-shaped pillow 20 with the rear supporting panel 100. A closure wall 326 engages the rear enclosure section 312 for covering the rear aperture 318 in the rear enclosure section 312. As shown in FIGS. 26 and 27, the closure wall 326 may be fastened by a zipper 328, hook and loop strips 330 or other fastening means.

FIGS. 19-29A illustrate a second embodiment 14 of the head and neck support device 10. The head and neck support device 10 comprises a generally U-shaped cushion 350 defining a rear cushion section 360, a first leg section 370 and a second leg section 380. The rear cushion section 360 defines an interior face 362, an exterior face 364, an upper face 366 and a lower face 368. The first leg section 370 defines an interior face 372, an exterior face 374, an upper face 376, a lower face 378 and an end face 379. The second leg section 380 defines an interior face 382, an exterior face 384, an upper face 386, a lower face 388 and an end face 389. The generally U-shaped cushion 350 may be constructed of a closed foam or other semi-rigid material.

All of the structural features of the rear supporting panel 100, a primary supporting panel 140 and a secondary supporting panel 180 in the second embodiment 14 may be identical to the first embodiment of FIGS. 1-18A. Similarly, all of the structural features of the generally U-shaped enclosure case 310 in the second embodiment 14 may be identical to the first embodiment of FIGS. 1-18A.

The first side edge 110 of the rear supporting panel 100 is secured to the back side edge 152 of the primary supporting panel 140 for defining a primary generally L-shaped frame 220. The second side edge 112 of the rear supporting panel 100 is secured to the back side edge 192 of the secondary supporting panel 180 for defining a secondary generally L-shaped frame 222. The primary generally L-shaped frame 220 and the secondary generally L-shaped frame 222 define a cushion enclosure frame 390 and a cushion cavity 392.

As best shown in FIGS. 19, 24, 25 and 26, the cushion cavity 392 receives the generally U-shaped cushion 350 for positioning the interior surface 142 of the primary supporting panel 140 adjacent to the first leg section 370 of the generally U-shaped cushion 350, positioning the interior surface 182 of the secondary supporting panel 180 adjacent to the second leg section 380 of the generally U-shaped cushion 350 and positioning the interior surface 102 of the rear supporting panel 100 adjacent to the rear cushion section 260 of the generally U-shaped cushion 350.

Thereafter, the rear aperture 318 located in the rear enclosure section 312 is utilized for positioning the primary supporting panel 140, the secondary supporting panel 180, the rear supporting panel 100 and the generally U-shaped enclosure case 310 within the generally U-shaped enclosure case 310. The generally U-shaped enclosure case 310 encases both the generally U-shaped enclosure case 310 and the head and neck support device 10 and retaining the generally U-shaped pillow 20 against the primary supporting panel 140, the secondary supporting panel 180, the rear supporting panel 100. The closure wall 326 engages the rear enclosure section 312 for covering the rear aperture 318 in the rear enclosure section 312. As shown in FIGS. 26 and 27, the closure wall 326 may be fastened by a zipper 328, hook and loop strips 330 or other fastening means.

The combined generally U-shaped cushion 350, the primary supporting panel 140, the secondary supporting panel 180, the rear supporting panel 100 and generally U-shaped enclosure case 310 encircles the neck 60 and is positioned adjacent to the first shoulder 70 and the second shoulder 72 of the individual 62.

The head and neck support device 10 limits the compression and or displacement of the generally U-shaped cushion 350 relative to the shoulders 70 and 72 and therefore reduces the angular displacements 76 and 79 of the head 64 and the neck 60 relative to the upper torso 66 by applying a plurality of forces 230 to the generally U-shaped cushion 350. In FIG. 28, the primary supporting panel 140 applies a first opposing force 232 in an inward direction towards the neck 60 of the individual 62 upon the displacement of the head 64 and neck 60 from the vertical position 71 towards the primary supporting panel 140 for preventing displacement of the first leg section 30 of the generally U-shaped cushion 350 relative to the neck 60 and supporting the head 64 and neck 60 in a generally vertical position 80. To assist the primary supporting panel 140 in FIG. 28, the secondary supporting panel 180 applies a third opposing force 234 in an outward direction away from the neck 60 of the individual 62 upon the displacement of the head 64 and neck 60 from the vertical position 71 towards the primary supporting panel 140 for preventing displacement of the first leg section 30 of the generally U-shaped cushion 350 relative to the neck 60 and supporting the head 64 and neck 60 is the generally vertical position 80.

Figure 28A:
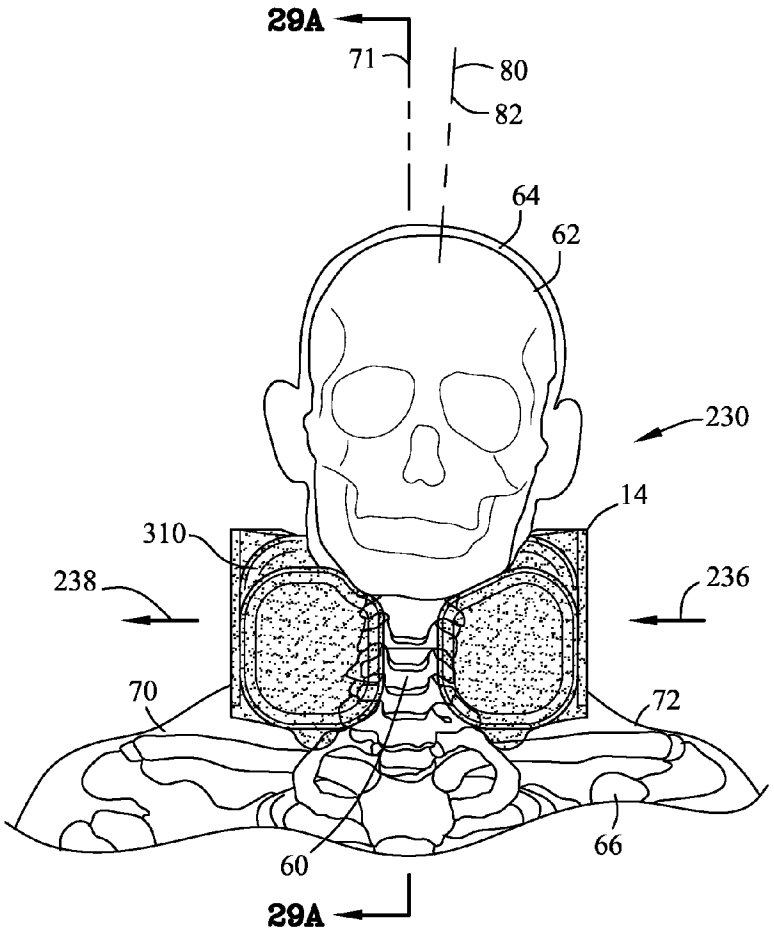
FIG. 28A is a front view of the head and neck support device of FIG. 19 positioned around a neck of an individual and applying a second opposing force and a fourth opposing force for supporting the head and neck in a generally vertical position.
Figure 28:
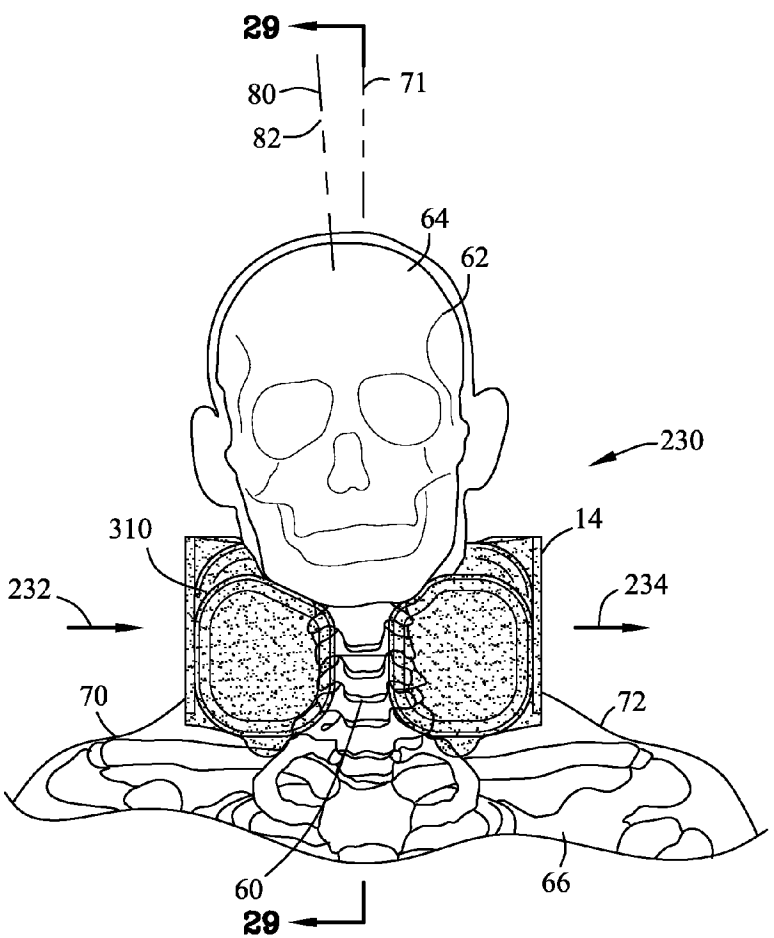
FIG. 28 is a front view of the head and neck support device of FIG. 19 positioned around a neck of an individual and applying a first opposing force and a third opposing force for supporting the head and neck in a generally vertical position.

In FIG. 28A, the secondary supporting panel 180 applies a second opposing force 236 in an inward direction towards the neck 60 of the individual 62 upon the displacement of the head 64 and neck 60 from the vertical position 71 towards the secondary supporting panel 180 for preventing displacement of the second leg section 40 of the generally U-shaped cushion 350 relative to the neck 60 and supporting the head 64 and neck 60 is the generally vertical position 80. To assist the secondary supporting panel 180, the primary supporting panel 140 applies a fourth opposing force 238 in an outward direction away from the neck 60 of the individual 62 upon the displacement of the head 64 and neck 60 from the vertical position 71 towards the secondary supporting panel 180 for preventing displacement of the second leg section 40 of the generally U-shaped cushion 350 relative to the neck 60 and supporting the head 64 and neck 60 in the generally vertical position 80.

Figure 29A:
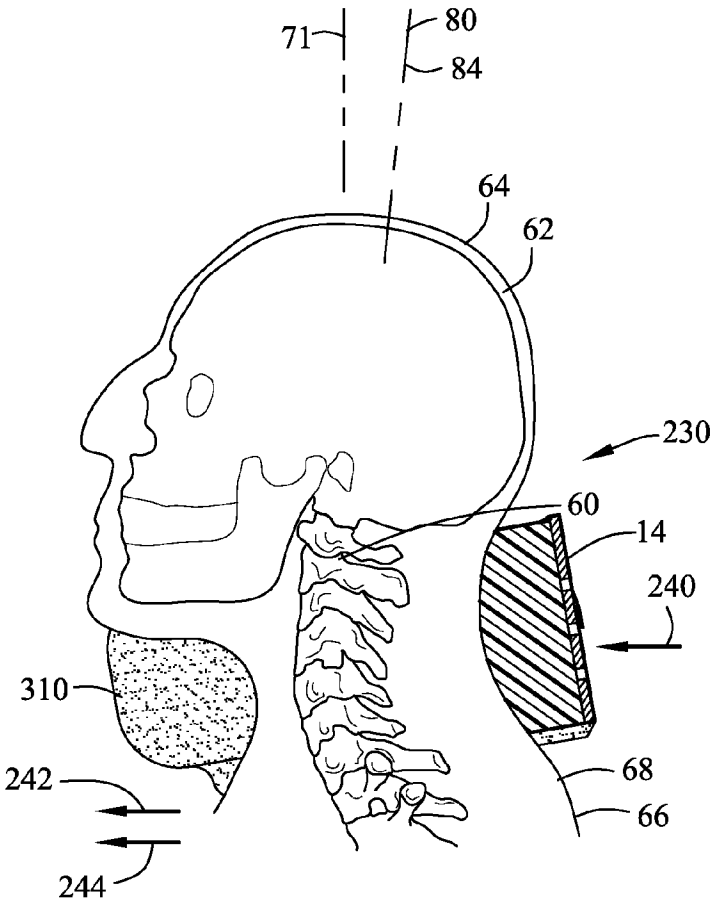
FIG. 29A is a side view of the head and neck support device of FIG. 19 positioned around a neck of an individual and applying a fifth opposing force, a sixth opposing force and a seventh opposing force for supporting the head and neck in a generally vertical position.
Figure 29:
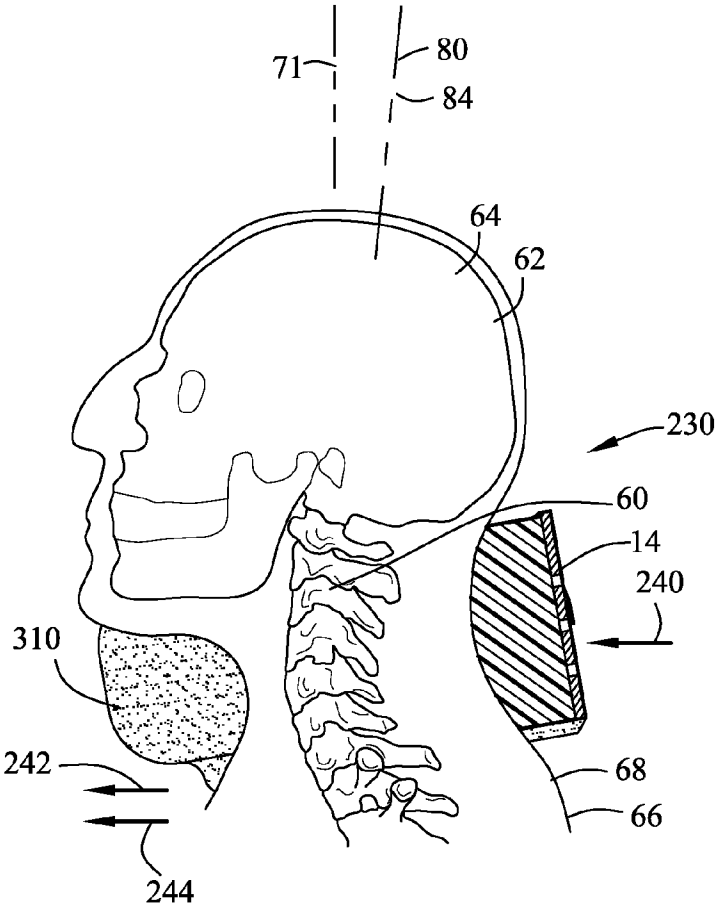
FIG. 29 is a side view of the head and neck support device of FIG. 19 positioned around a neck of an individual and applying a fifth opposing force, a sixth opposing force and a seventh opposing force for supporting the head and neck in a generally vertical position.
Figure 30:
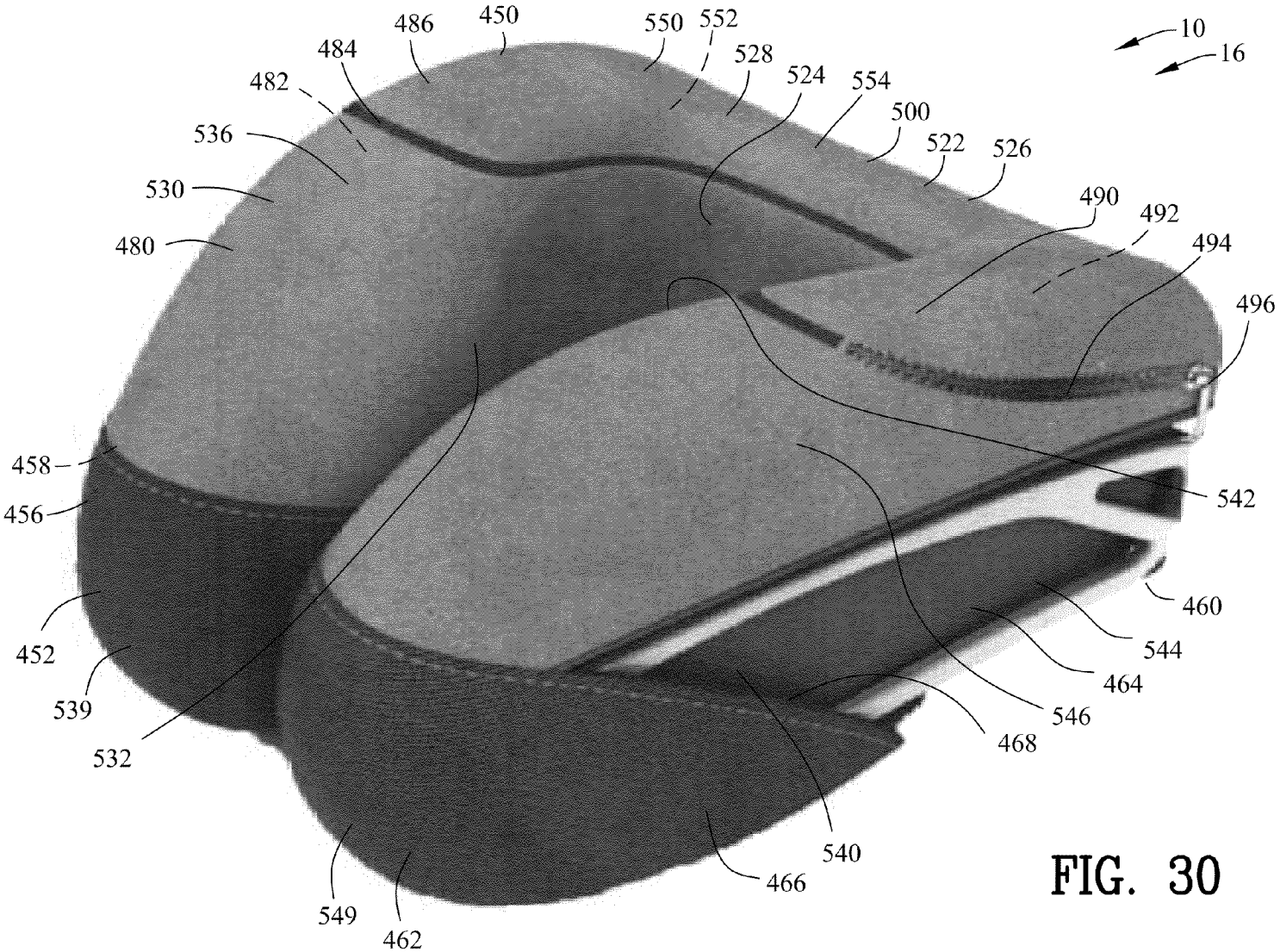
FIG. 30 is a front isometric view of a third embodiment of a head and neck support device encircling a neck of an individual.
Figure 31:
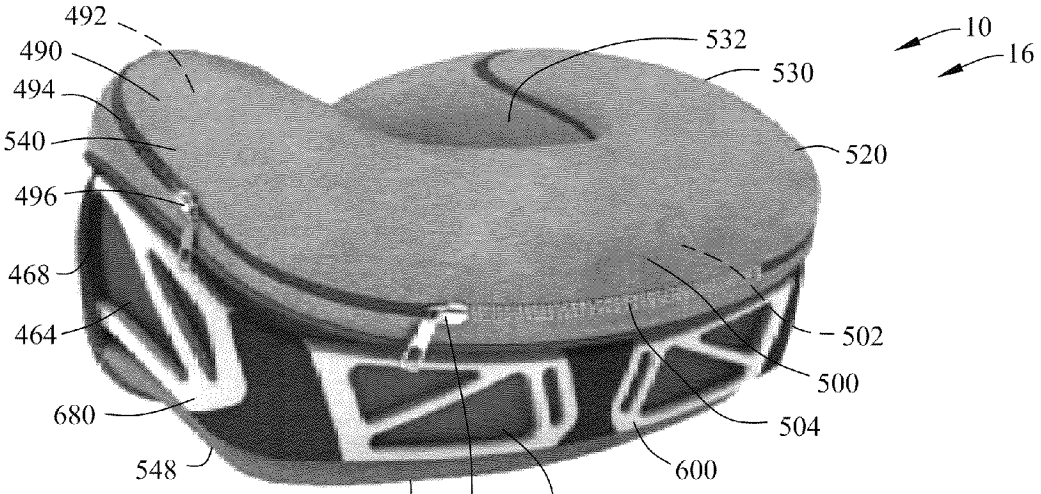
FIG. 31 is a left rear isometric view of the head and neck support device of FIG. 30.
Figure 32:
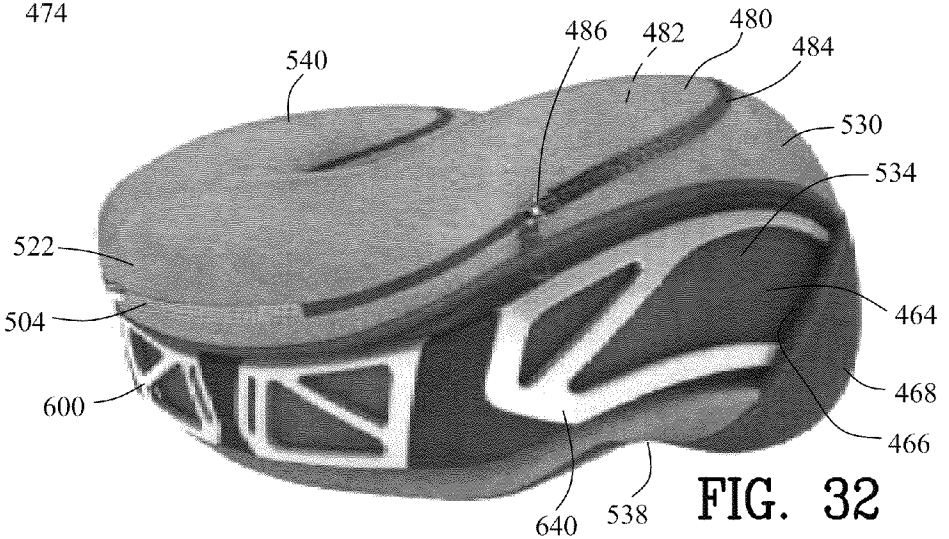
FIG. 32 is a right rear isometric view of the head and neck support device of FIG. 30.
Figure 33:
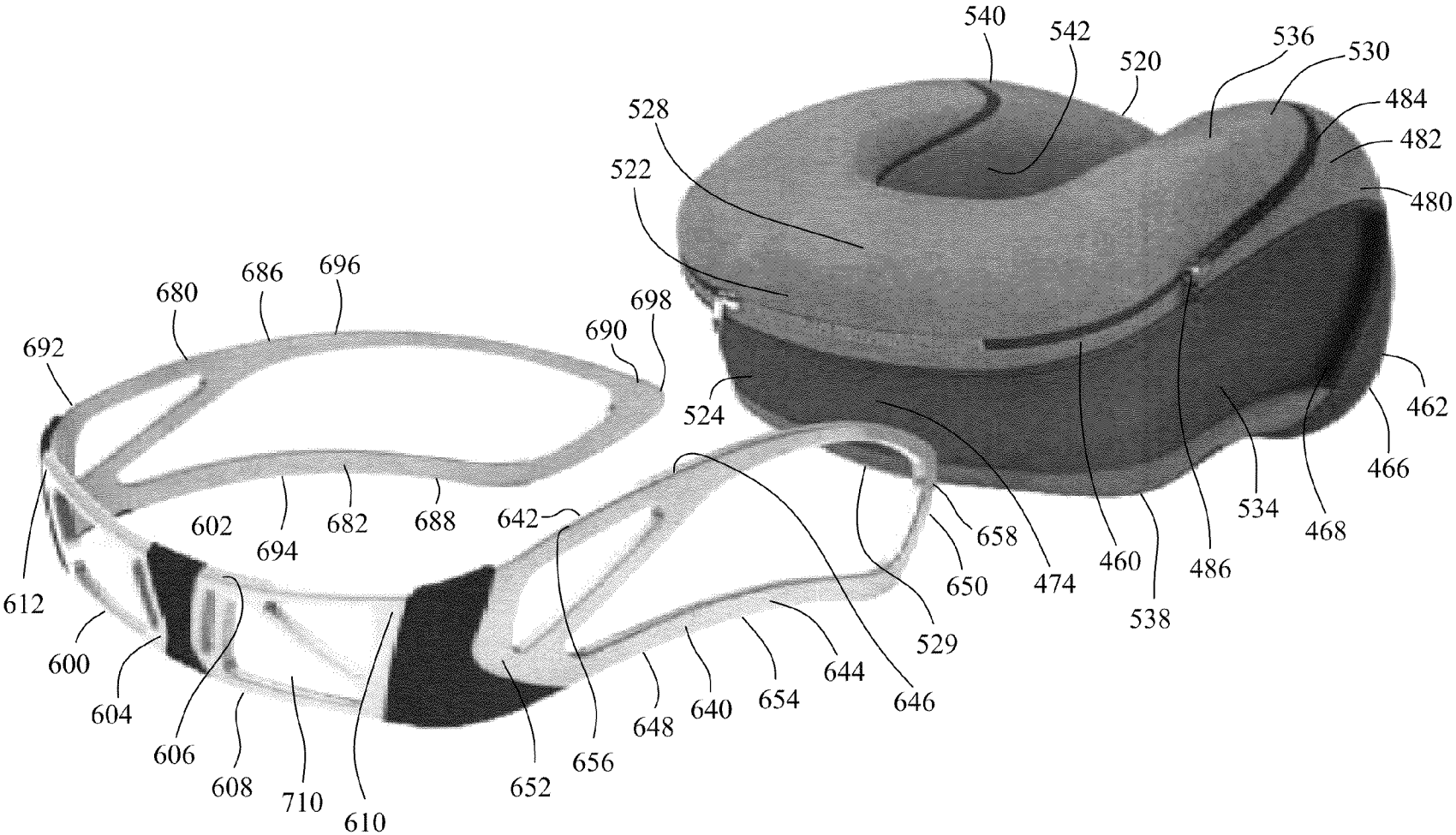
FIG. 33 is an exploded isometric view of the FIG. 32.

In FIGS. 29 and 29A, the rear supporting panel 100 applies a fifth opposing force 240 in an inward direction towards the neck 60 of the individual 62 upon the displacement of the head 64 and neck 60 from the vertical position 71 towards the rear supporting panel 100 for preventing displacement of the rear pillow section 22 of the generally U-shaped cushion 350 relative to the neck 60 and supporting the head 64 and neck 60 in the generally vertical position 80.

Upon a left or tight lateral displacement 74 of the head 64 and neck 60 from a vertical position 71 as shown in FIGS. 28 and 28A, the generally U-shaped cushion 350 is limited in its compression and or displacement relative to the shoulders 70 and 72 of the individual 62 resulting in a first reduced angular displacement 82 of the head 64 and neck 60 relative to the upper torso 66 of the individual 62. Furthermore, upon the rear lateral displacement 78 of the head 64 and neck 60 from the vertical position 71 as shown in FIGS. 29 and 29A, the generally U-shaped cushion 350 is limited in its compression and or displacement relative to the shoulders 70 and 72 of the individual 62 resulting in a second reduced angular displacement 84 of the head 64 and neck 60 relative to the upper torso 66 of the individual 62.

As best shown in FIGS. 19, 24, 25, 29 and 29A, the lower edge 148 of the primary supporting panel 140 includes a primary concave edge 154 for conforming to the first shoulder 70 of the individual 62. The lower edge 188 of the secondary supporting panel 180 includes a secondary concave edge 194 for conforming to the second shoulder 72 of the individual 62. The primary concave edge 154 of the primary supporting panel 140 permits the primary supporting panel 140 to assists the rear supporting panel 100 by applying a sixth opposing force 242 in an outward direction away from the neck 60 of the individual 62 upon the displacement of the head 64 and neck 60 from the vertical position 71 towards the rear supporting panel 100 for preventing displacement of the rear pillow section 22 of the generally U-shaped cushion 350 relative to the neck 60 and supporting the head 64 and neck 60 in the generally vertical position 80.

Similarly, secondary concave edge 194 of the secondary supporting panel 180 permits the secondary supporting panel 180 to assists the rear supporting panel 100 by applying applies a seventh opposing force 244 in an outward direction away from the neck 60 of the individual 62 upon the displacement of the head 64 and neck 60 from the vertical position 71 towards the rear supporting panel 100 for preventing displacement of the rear pillow section 22 of the generally U-shaped cushion 350 relative to the neck 60 and supporting the head 64 and neck 60 in the generally vertical position 80.

As best shown in FIGS. 20-29A, the lower face 378 of the first leg section 370 includes a first elongated rib cushion 400 for elevating the first leg section 370 of the generally U-shaped cushion 350 relative to the neck 60. The lower face 388 of the second leg section 380 includes a second elongated rib cushion 402 for elevating the second leg section 380 of the generally U-shaped cushion 350 relative to the neck 60. The interior face 372 of the first leg section 370 includes a first concave cushion surface 404 for conforming to the neck 60 of the individual 62. The interior face 382 of the second leg section 380 includes a second concave cushion surface 406 for conforming to the neck 60 of the individual 62. The interior face 372 of the first leg section 370 may further include a first linear taper cushion surface 410 abutting the interior face 362 of the rear cushion section 360 for promoting the neck 60 of the individual 62 to contact the interior face 362 of the rear cushion section 360. The interior face 382 of the second leg section 380 includes a second linear taper cushion surface 412 abutting the interior face 362 of the rear cushion section 360 for promoting the neck 60 of the individual 62 to contact the interior face 362 of the rear cushion section 360. The lower face 368 of the rear cushion section 360 includes a concave cushion surface 414 for conforming to the back 68 of the individual 62 and for elevating the rear cushion section 360 of the generally U-shaped cushion 350 relative to the neck 60. The interior face 362 of the rear cushion section 360 includes a rear convex surface 416 for conforming to the neck 60 of the individual 62.

FIGS. 30-45 illustrate a third embodiment 16 of the head and neck support device 10. The head and neck support device 10 comprises a generally U-shaped cushion 520 defining a rear cushion section 522, a first leg section 530 and a second leg section 540. The rear cushion section 522 defines an interior face 524, an exterior face 526, an upper face 528 and a lower face 529. The first leg section 530 defines an interior face 532, an exterior face 534, an upper face 536, a lower face 538, an end face 539 extending between a proximal end 450 and a distal end 452. The second leg section 540 defines an interior face 542, an exterior face 544, an upper face 546, a lower face 548, an end face 549 extending between a proximal end 460 and a distal end 462. The generally U-shaped cushion 520 may be constructed of a closed foam or other semi-rigid material. Typically the generally U-shaped pillow 520 is constructed of a flexible fabric 550 that contains either a foam material 552 or a bead material 554.

A first leg groove 454 traverses the exterior face 534 of the first leg section 530. A second leg groove 464 traverses the exterior face 544 of the second leg section 540. A rear groove 474 traverses the exterior face 526 of the rear cushion section 522.

The rear supporting panel 600 has an interior surface 602, an exterior surface 604, an upper edge 606, a lower edge 608, a first side edge 610 and a second side edge 612. The primary supporting panel 640 has an interior surface 642, an exterior surface 644, an upper edge 646, a lower edge 648, a front side edge 650 and a back side edge 652. The secondary supporting panel 680 has an interior surface 682, an exterior surface 684, an upper edge 686, a lower edge 688, a front side edge 690 and a back side edge 692.

The first side edge 610 of the rear supporting panel 600 is secured to the back side edge 652 of the primary supporting panel 640 for defining a primary generally L-shaped frame 720. The second side edge 612 of the rear supporting panel 600 is secured to the back side edge 692 of the secondary supporting panel 680 for defining a secondary generally L-shaped frame 722. The primary generally L-shaped frame 720 and the secondary generally L-shaped frame 722 define a pillow enclosure frame 724 and a pillow cavity 726. The rear supporting panel 600, primary supporting panel 640 and secondary supporting panel 680 may include a matrix of holes 710 for permitting ventilation into the pillow cavity 626 and reducing of material needed for construction.

The pillow cavity 726 receives the generally U-shaped pillow 520 for positioning the interior surface 642 of the primary supporting panel 640 adjacent to the first leg section 530 of the generally U-shaped pillow 520, positioning the interior surface 682 of the secondary supporting panel 680 adjacent to the second leg section 540 of the generally U-shaped pillow 520 and positioning the interior surface 602 of the rear supporting panel 600 adjacent to the rear pillow section 522 of the generally U-shaped pillow 520.

The first leg groove 454, the second leg groove 464 and the rear groove 474 receiving the primary supporting panel 640, the secondary supporting panel 680 and the rear supporting panel 600 respectively for interlocking the generally U-shaped cushion 520 relative to the cushion enclosure frame 724.

A first leg groove cover 456 may be adjacent to the distal end 452 of the first leg section 530 for extending over the first leg groove 454 and defining a first leg pocket 458. A second leg groove cover 466 may be adjacent to the distal end 462 of the second leg section 540 and extends over the second leg groove 464 for defining a second leg pocket 468. The first leg pocket 458 and the second leg pocket 468 receive the primary supporting panel 640 and the secondary supporting panel 680 respectively for interlocking the generally U-shaped cushion 520 relative to the cushion enclosure frame 624.

The pillow enclosure frame 724 encircles the generally U-shaped pillow 520 for positioning the lower edge 648 of the primary supporting panel 640 adjacent to the first shoulder 70 and the lower edge 688 of the secondary supporting panel 680 adjacent to the second shoulder 72.

Similar to FIGS. 15-18A and 28-29A, the head and neck support device 16 limits the compression and or displacement of the generally U-shaped pillow 520 relative to the shoulders 70 and 72 and therefore reduces the angular displacements 76 and 79 of the head 64 and the neck 60 relative to the upper torso 66 by applying a plurality of forces 730 to the generally U-shaped pillow 520. The primary supporting panel 640 applies a first opposing force 732 in an inward direction towards the neck 60 of the individual 62 upon the displacement of the head 64 and neck 60 from the vertical position 71 towards the primary supporting panel 640 for preventing displacement of the first leg section 530 of the generally U-shaped pillow 520 relative to the neck 60 and supporting the head 64 and neck 60 in a generally vertical position 80. To assist the primary supporting panel 640, the secondary supporting panel 680 applies a third opposing force 734 in an outward direction away from the neck 60 of the individual 62 upon the displacement of the head 64 and neck 60 from the vertical position 71 towards the primary supporting panel 640 for preventing displacement of the first leg section 530 of the generally U-shaped pillow 520 relative to the neck 60 and supporting the head 64 and neck 60 is the generally vertical position 80.

The secondary supporting panel 680 applies a second opposing force 736 in an inward direction towards the neck 60 of the individual 62 upon the displacement of the head 64 and neck 60 from the vertical position 71 towards the secondary supporting panel 680 for preventing displacement of the second leg section 40 of the generally U-shaped pillow 520 relative to the neck 60 and supporting the head 64 and neck 60 is the generally vertical position 80. To assist the secondary supporting panel 680, the primary supporting panel 640 applies a fourth opposing force 738 in an outward direction away from the neck 60 of the individual 62 upon the displacement of the head 64 and neck 60 from the vertical position 71 towards the secondary supporting panel 680 for preventing displacement of the second leg section 540 of the generally U-shaped pillow 520 relative to the neck 60 and supporting the head 64 and neck 60 in the generally vertical position 80.

The rear supporting panel 600 applies a fifth opposing force 740 in an inward direction towards the neck 60 of the individual 62 upon the displacement of the head 64 and neck 60 from the vertical position 71 towards the rear supporting panel 600 for preventing displacement of the rear pillow section 522 of the generally U-shaped pillow 520 relative to the neck 60 and supporting the head 64 and neck 60 in the generally vertical position 80.

Upon a left or right lateral displacement 74 of the head 64 and neck 60 from a vertical position 71 similarly as shown in FIGS. 17 and 17A, the generally U-shaped pillow 520 is limited in its compression and or displacement relative to the shoulders 70 and 72 of the individual 62 resulting in a first reduced angular displacement 82 of the head 64 and neck 60 relative to the upper torso 66 of the individual 62. Furthermore, upon the rear lateral displacement 78 of the head 64 and neck 60 from the vertical position 71 similarly as shown in FIGS. 18 and 18A, the generally U-shaped pillow 520 is limited in its compression and or displacement relative to the shoulders 70 and 72 of the individual 62 resulting in a second reduced angular displacement 84 of the head 64 and neck 60 relative to the upper torso 66 of the individual 62.

Figure 45:
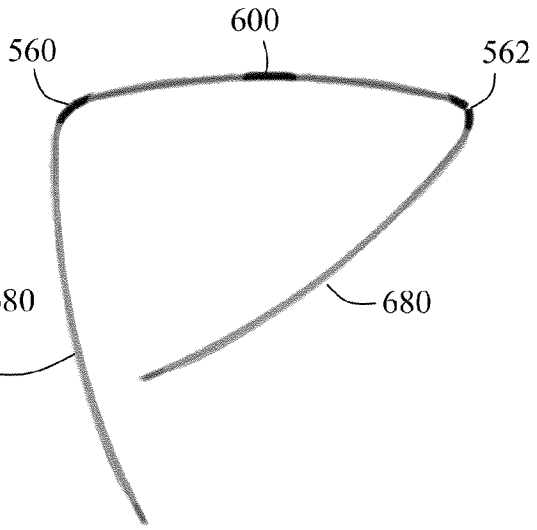
FIG. 45 is a view similar to FIG. 43 illustrating a pivoted position of the secondary supporting panel relative to the rear supporting panel.
Figure 44:
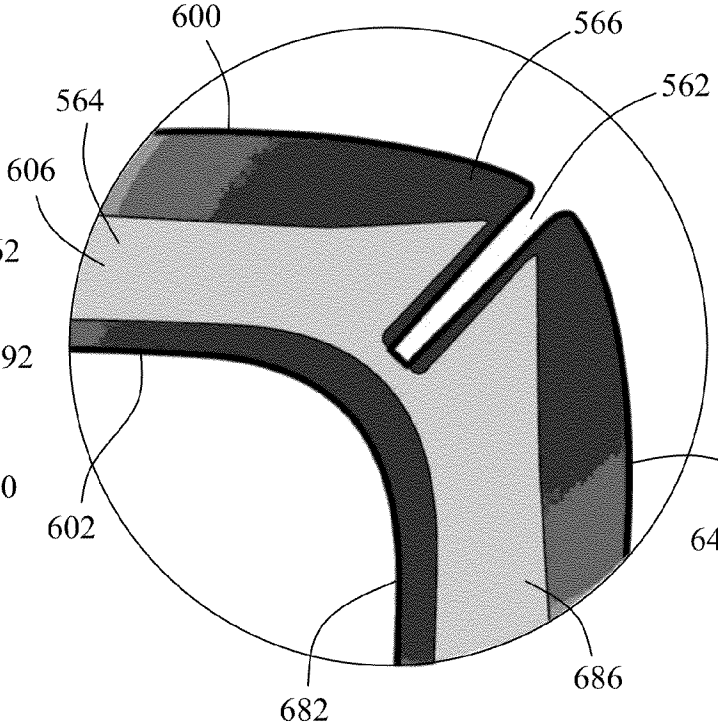
FIG. 44 is an enlarged portion of FIG. 43 illustrating a second groove hinge for permitting pivoting of the secondary supporting panel relative to the rear supporting panel.
Figure 43:
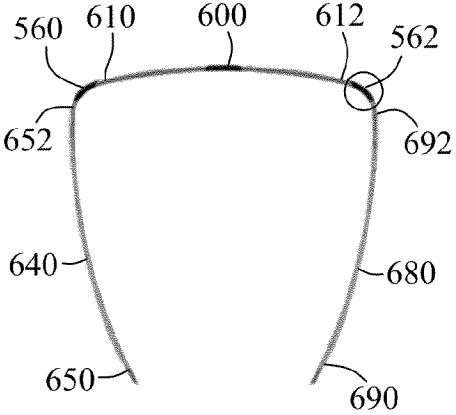
FIG. 43 is a view similar to FIG. 40 illustrating a non-pivoted position of the primary supporting panel and the secondary supporting panel relative to the rear supporting panel.

The rear supporting panel 600, the primary supporting panel 640 and the secondary supporting panel 680 may be constructed from an integral one piece unit. As shown in FIGS. 43-45, the primary supporting panel 640 may be pivotably coupled to the rear supporting panel 600 and the secondary supporting panel 680 may be pivotably coupled to the rear supporting panel 600. More specifically, a first groove hinge 560 may couple the first side edge 610 of the rear supporting panel 600 and the back side edge 652 of the primary supporting panel 640 for pivoting the primary supporting panel 640 between the primary generally L-shaped frame 720 and a first parallel orientation 721 with the rear supporting panel 600. A second groove hinge 562 may couple the second side edge 612 of the rear supporting panel 600 and the back side edge 692 of the secondary supporting panel 680 for pivoting the secondary supporting panel 680 between the secondary generally L-shaped frame 722 and a second parallel orientation 723 with the rear supporting panel 600.

The lower edge 648 of the primary supporting panel 640 may include a primary concave edge 654 for conforming to the first shoulder 70 of the individual 62. The lower edge 688 of the secondary supporting panel 680 includes a secondary concave edge 694 for conforming to the second shoulder 72 of the individual 62. The primary concave edge 654 of the primary supporting panel 640 permits the primary supporting panel 640 to assist the rear supporting panel 600 by applying a sixth opposing force 742 in an outward direction away from the neck 60 of the individual 62 upon the displacement of the head 64 and neck 60 from the vertical position 71 towards the rear supporting panel 600 for preventing displacement of the rear pillow section 522 of the generally U-shaped pillow 520 relative to the neck 60 and supporting the head 64 and neck 60 in the generally vertical position 80.

Similarly, the secondary concave edge 694 of the secondary supporting panel 680 permits the secondary supporting panel 680 to assists the rear supporting panel 600 by applying applies a seventh opposing force 744 in an outward direction away from the neck 60 of the individual 62 upon the displacement of the head 64 and neck 60 from the vertical position 71 towards the rear supporting panel 600 for preventing displacement of the rear pillow section 522 of the generally U-shaped pillow 520 relative to the neck 60 and supporting the head 64 and neck 60 in the generally vertical position 80.

The upper edge 646 of the primary supporting panel 640 may include a primary arc edge 656 for conforming to the head 64 of the individual 62. The upper edge 686 of the secondary supporting panel 680 may include a secondary arc edge 696 for conforming to the head 64 of the individual 62. The front side edge 650 of the primary supporting panel 640 may include a primary convex edge 658 for conforming to the first shoulder 70 and the head 64 of the individual 62. The front side edge 690 of the secondary supporting panel 680 may include a secondary convex edge 698 for conforming to the second shoulder 72 and head 64 of the individual 62. The upper edge 606 of the rear supporting panel 600 may include a rear concave edge 616 for conforming to the head 64 of the individual 62.

Figure 34:
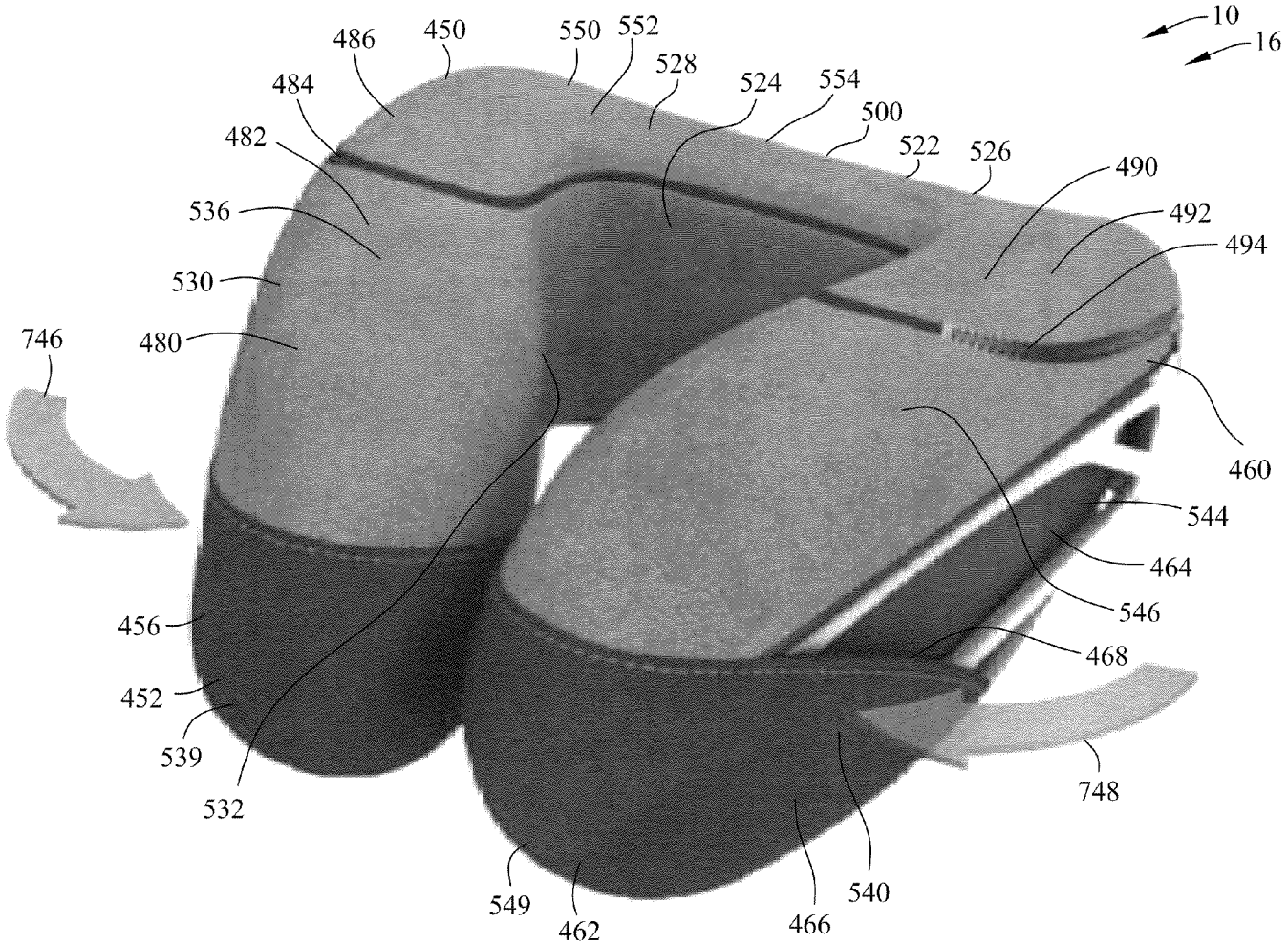
FIG. 34 is a view similar to FIG. 30 illustrating a first converging force and a second converging force from the primary supporting panel and the secondary supporting panel respectively for converging the first leg section and the second leg section together.
Figure 35:
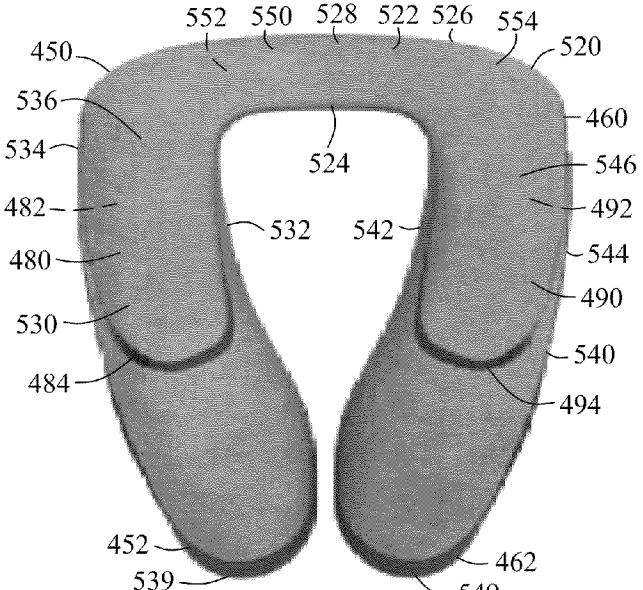
FIG. 35 is a top view of FIG. 30.
Figure 36:
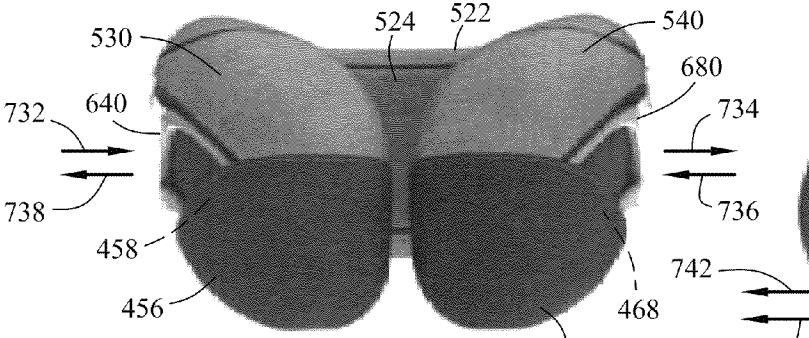
FIG. 36 is a front view of FIG. 30.
Figure 37:
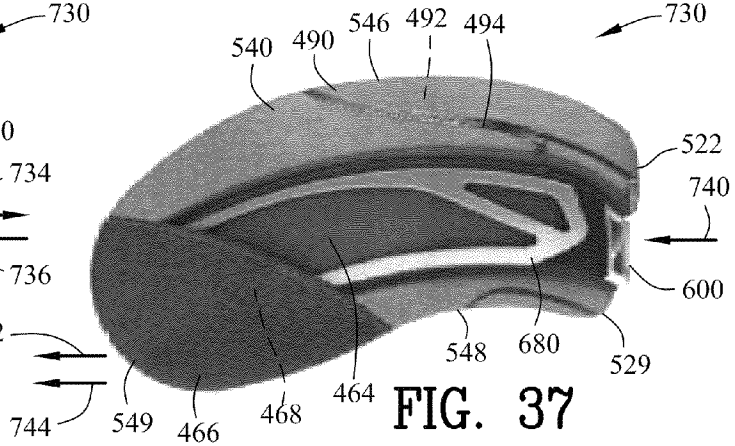
FIG. 37 is a left side view of FIG. 30.
Figure 38:
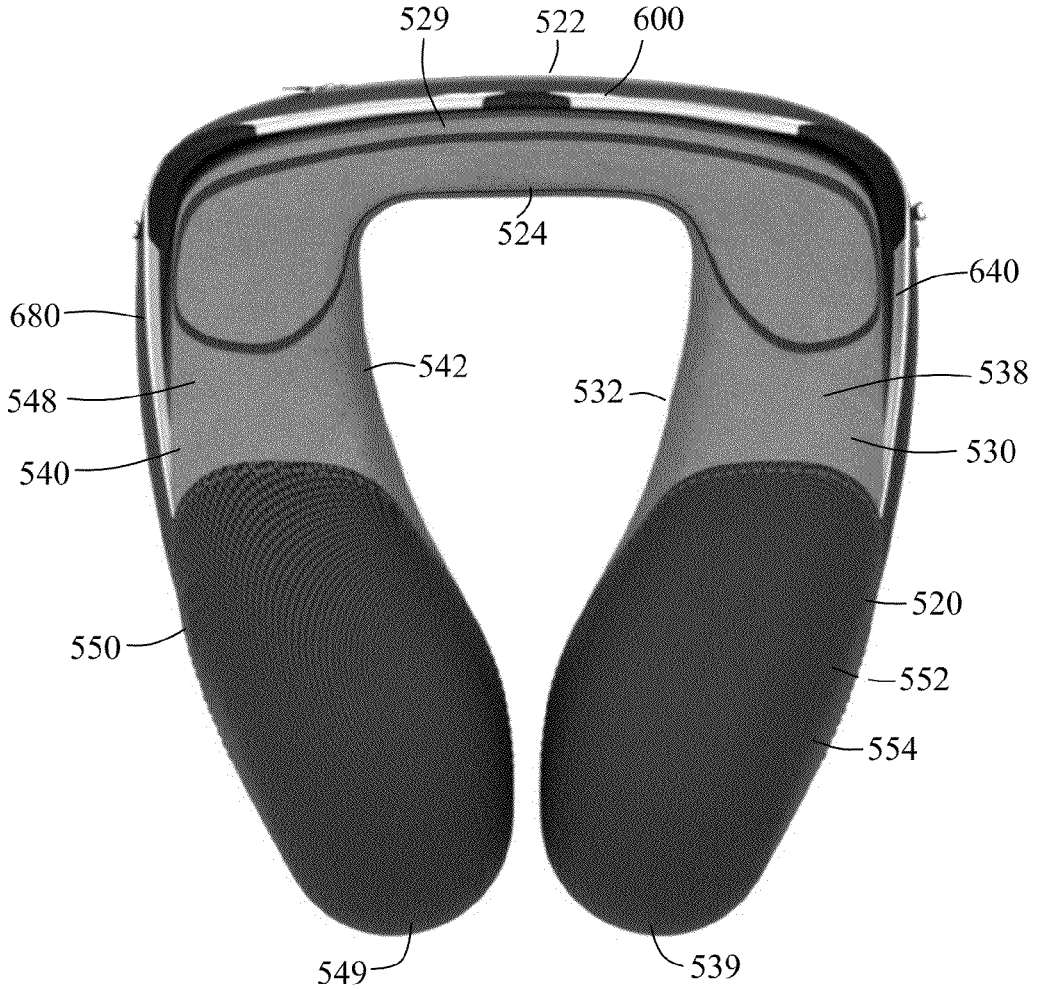
FIG. 38 is a bottom view of FIG. 30.
Figure 39:
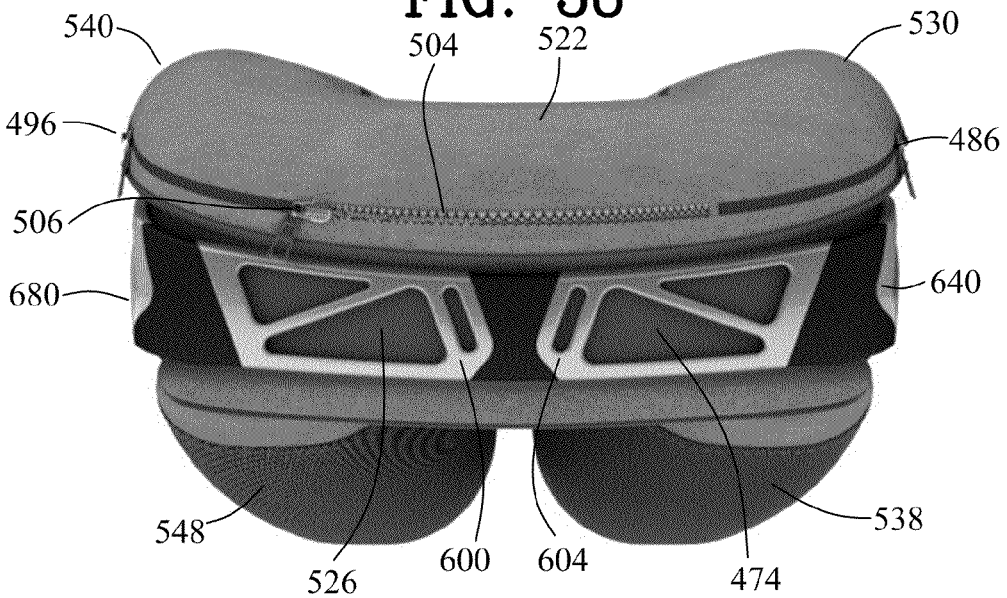
FIG. 39 is a rear view of FIG. 30.
Figure 40:
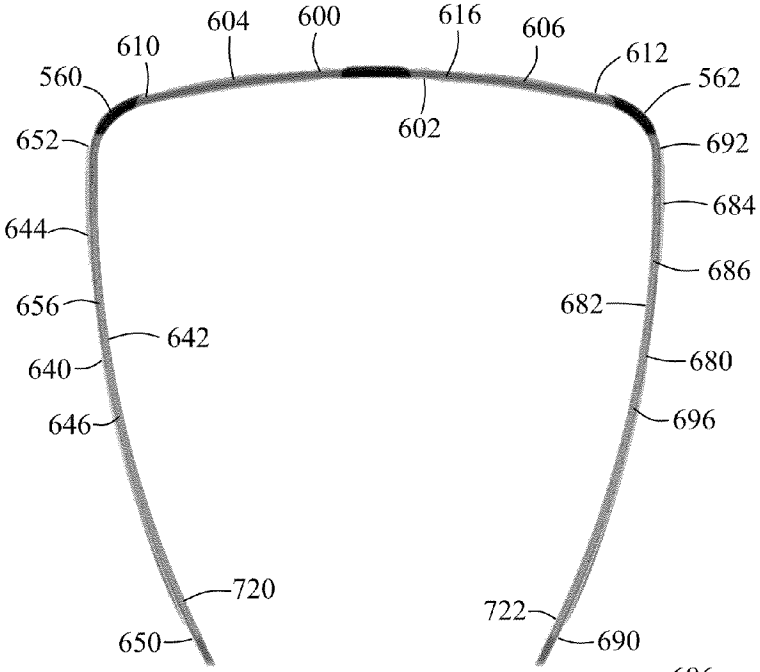
FIG. 40 is a top view of a pillow enclosure frame of FIG. 30.
Figure 41:
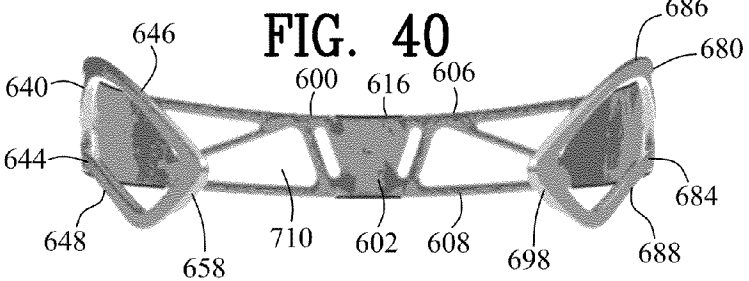
FIG. 41 is a front view of FIG. 40.
Figure 42:
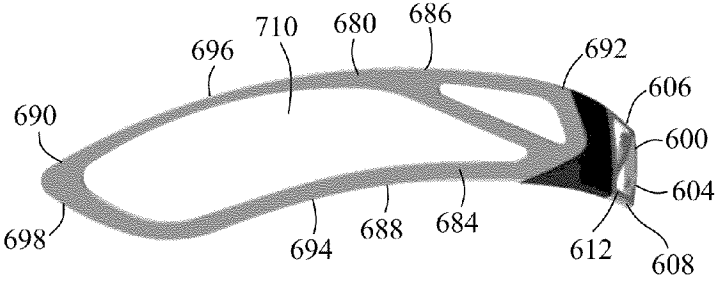
FIG. 42 is a left side view of FIG. 40.

As shown in FIG. 34, the primary supporting panel 640 provides a first converging force 746 and the secondary supporting panel 680 provides a second converging force 748 for converging the first leg section and the second leg section together. The first converging force 746 and the second converging force 748 assists in maintaining the first leg section 530 and the second leg section 540 of the generally U-shaped pillow 520 against the neck 60.

The first leg section 530 may further include a first cushion chamber 480 for receiving a first additional cushion material 482. The first leg section 530 has a first cushion aperture 484 for inputting the first additional cushion material 482 into the first cushion chamber 480. A first closure 486 engages the first cushion aperture 484 for closing the first cushion aperture 484.

The second leg section 540 may further include a second cushion chamber 490 for receiving a second additional cushion material 492. The second leg section 540 has a second cushion aperture 494 for inputting the second additional cushion material 492 into the second cushion chamber 490. A second closure 496 engages the second cushion aperture 494 for closing the second cushion aperture 494.

The rear cushion section 522 may further include a third cushion chamber 500 for receiving a third additional cushion material 502. The rear cushion section 522 has a third cushion aperture 504 for inputting the third additional cushion material 502 into the third cushion chamber 500. A third closure 506 engages the third cushion aperture 504 for closing the third cushion aperture 504.

The first additional cushion material 482, the second additional cushion material 492 and the third additional cushion material 502 permits the expansion of the generally U-shaped pillow 520 for allowing the generally U-shaped pillow 520 to abut against the neck 60 and/or the head 64 of the individual 62. The first closure 486, second closure 496 and third closure 506 may include a zipper, hook and loop, buttons or the other fastening means.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A head and neck support device for positioning about a neck of an individual, the neck joining a head with a torso of the individual, the torso having a first shoulder and a second shoulder, a generally U-shaped pillow encircling the neck and positioned adjacent to the first shoulder and the second shoulder of the individual, the generally U-shaped pillow having a rear pillow section, a first leg section and a second leg section, the head and neck support device, comprising;

a rear supporting panel defining an interior surface, an exterior surface, an upper edge, a lower edge, a first side edge and a second side edge;

a primary supporting panel defining an interior surface, an exterior surface, an upper edge, a lower edge, a front side edge and a back side edge;

said first side edge of said rear supporting panel secured to said back side edge of said primary supporting panel for defining a primary generally L-shaped frame;

a secondary supporting panel defining an interior surface, an exterior surface, an upper edge, a lower edge, a front side edge and a back side edge;

said second side edge of said rear supporting panel secured to said back side edge of said secondary supporting panel for defining a secondary generally L-shaped frame;

said primary generally L-shaped frame and said secondary generally L-shaped frame defining a pillow enclosure frame and a pillow cavity;

said pillow cavity receiving the generally U-shaped pillow for positioning said interior surface of said primary supporting panel adjacent to the first leg section of the generally U-shaped pillow and positioning said interior surface of said secondary supporting panel adjacent to the second leg section of the generally U-shaped pillow;

said pillow enclosure frame encircling the generally U-shaped pillow for positioning said lower edge of said primary supporting panel adjacent to the first shoulder and said lower edge of said secondary supporting panel adjacent to the second shoulder;

said primary supporting panel applying a first opposing force in an inward direction towards the neck of the individual upon the displacement of the head and neck from a vertical position towards said primary supporting panel for preventing displacement of the first leg section of the generally U-shaped pillow relative to the neck and supporting the head and neck in a generally vertical position;

said secondary supporting panel applying a second opposing force in an inward direction towards the neck of the individual upon the displacement of the head and neck from a vertical position towards said secondary supporting panel for preventing displacement of the second leg section of the generally U-shaped pillow relative to the neck and supporting the head and neck in a generally vertical position;

a first hinge coupling said first side edge of said rear supporting panel and said back side edge of said primary supporting panel for pivoting said primary supporting panel between said primary generally L-shaped frame and a first parallel orientation with said rear supporting panel; and a second hinge coupling said second side edge of said rear supporting panel and said back side edge of said secondary supporting panel for pivoting said secondary supporting panel between said secondary generally L-shaped frame and a second parallel orientation with said rear supporting panel.

2. A head and neck support device as set forth in claim 1, wherein said upper edge of said primary supporting panel includes a primary arc edge for conforming to the head of the individual; and said upper edge of said secondary supporting panel includes a secondary arc edge for conforming to the head of the individual.

3. A head and neck support device as set forth in claim 1, wherein said front side edge of said primary supporting panel includes a primary convex edge for conforming to the first shoulder and the head of the individual; and said front side edge of said secondary supporting panel includes a secondary convex edge for conforming to the second shoulder and head of the individual.

4. A head and neck support device as set forth in claim 1, further including a first sheet having a bottom surface and a loop top surface;

a first sheet coupling securing said bottom surface of said first sheet to said interior surface of said primary supporting panel;

a second sheet having a bottom surface and a hook top surface;

a second sheet coupling securing said bottom surface of said second sheet to the first leg section of the generally U-shaped pillow;

said loop top surface of said first sheet engaging said hook top surface of said second sheet for fastening the first leg section of the generally U-shaped pillow with said primary supporting panel;

a third sheet having a bottom surface and a loop top surface;

a third sheet coupling securing said bottom surface of said third sheet to said interior surface of said secondary supporting panel;

a fourth sheet having a bottom surface and a hook top surface;

a fourth sheet coupling securing said bottom surface of said fourth sheet to the second leg section of the generally U-shaped pillow; and said loop top surface of said third sheet engaging said hook top surface of said fourth sheet for fastening the second leg section of the generally U-shaped pillow with said secondary supporting panel.

5. A head and neck support device as set forth in claim 1, further including a first elastic band secured to the first leg section of the generally U-shaped pillow;

said first elastic band expanding around said primary supporting panel for fastening the first leg section of the generally U-shaped pillow with the primary supporting panel;

a second elastic band secured to the second leg section of the generally U-shaped pillow;

and said second elastic band expanding around said secondary supporting panel for fastening the second leg section of the generally U-shaped pillow with the secondary supporting panel.

6. A head and neck support device as set forth in claim 1, further including a generally U-shaped enclosure case having a rear enclosure section, a first leg enclosure section and a second leg enclosure section;

a rear aperture in said rear enclosure section for positioning said primary supporting panel, said secondary supporting panel, said rear supporting panel and said generally U-shaped pillow within said generally U-shaped enclosure case;

said first leg enclosure section defining a first leg enclosure chamber for receiving and fastening the first leg section of the generally U-shaped pillow with said primary supporting panel;

said second leg enclosure section defining a second leg enclosure chamber for receiving and fastening the second leg section of the generally U-shaped pillow with said secondary supporting panel;

said rear enclosure section defining a rear enclosure chamber for receiving and fastening the rear pillow section of the generally U-shaped pillow with said rear supporting panel; and a closure wall engaging said rear enclosure section for covering said rear aperture in said rear enclosure section.

7. A head and neck support device for positioning about a neck of an individual, the neck joining a head with a torso of the individual, the torso having a first shoulder, a second shoulder, a back and a chest, the head and neck support device comprising;

a generally U-shaped cushion defining a rear cushion section, a first leg section and a second leg section, said rear cushion section defining an interior face, an exterior face, an upper face and a lower face;

said first leg section defining an interior face, an exterior face, an upper face, a lower face and an end face;

said second leg section defining an interior face, an exterior face, an upper face, a lower face and an end face;

a rear supporting panel defining an interior surface, an exterior surface, an upper edge, a lower edge, a first side edge and a second side edge;

a primary supporting panel defining an interior surface, an exterior surface, an upper edge, a lower edge, a front side edge and a back side edge;

said first side edge of said rear supporting panel secured to said back side edge of said primary supporting panel for defining a primary generally L-shaped frame;

a secondary supporting panel defining an interior surface, an exterior surface, an upper edge, a lower edge, a front side edge and a back side edge;

said second side edge of said rear supporting panel secured to said back side edge of said secondary supporting panel for defining a secondary generally L-shaped frame;

said primary generally L-shaped frame and said secondary generally L-shaped frame defining a cushion enclosure frame and a cushion cavity;

said generally U-shaped cushion encircling the neck and positioned adjacent to the first shoulder and the second shoulder of the individual;

said cushion cavity receiving said generally U-shaped cushion for positioning said interior surface of said primary supporting panel adjacent to said first leg section of said generally U-shaped cushion and positioning said interior surface of said secondary supporting panel adjacent to said second leg section of said generally U-shaped cushion;

said cushion enclosure frame encircling said generally U-shaped cushion for positioning said lower edge of said primary supporting panel and said adjacent to the first shoulder and said lower edge of said secondary supporting panel adjacent to the second shoulder;

said primary supporting panel applying a first opposing force in an inward direction towards the neck of the individual upon the displacement of the head and neck from a vertical position towards said primary supporting panel for preventing displacement of said first leg section of said generally U-shaped cushion relative to the neck and supporting the head and neck in a generally vertical position;

said secondary supporting panel applying a second opposing force in an inward direction towards the neck of the individual upon the displacement of the head and neck from a vertical position towards said secondary supporting panel for preventing displacement of said second leg section of said generally U-shaped cushion relative to the neck and supporting the head and neck in a generally vertical position;

a generally U-shaped enclosure case having a rear enclosure section, a first leg enclosure section and a second leg enclosure section;

a rear aperture in said rear enclosure section for positioning said primary supporting panel, said secondary supporting panel, said rear supporting panel and said generally U-shaped cushion within said generally U-shaped enclosure case;

said first leg enclosure section defining a first leg enclosure chamber for receiving and fastening the first leg section of the generally U-shaped cushion with said primary supporting panel;

said second leg enclosure section defining a second leg enclosure chamber for receiving and fastening the second leg section of the generally U-shaped cushion with said secondary supporting panel:

said rear enclosure section defining a rear enclosure chamber for receiving and fastening the rear cushion section of the generally U-shaped cushion with said rear supporting panel; and a closure wall engaging said rear enclosure section for covering said rear aperture in said rear enclosure section.

8. A head and neck support device as set forth in claim 7, wherein said lower face of said first leg section including a first elongated rib cushion for elevating said first leg section of said generally U-shaped cushion relative to the neck; and said lower face of said second leg section including a second elongated rib cushion for elevating said second leg section of said generally U-shaped cushion relative to the neck.

9. A head and neck support device as set forth in claim 7, wherein said interior face of said first leg section including a first concave cushion surface for conforming to the neck of the individual; and said interior face of said second leg section including a second concave cushion surface for conforming to the neck of the individual.

10. A head and neck support device as set forth in claim 7, wherein said interior face of said first leg section including a first linear taper cushion surface abutting said interior face of said rear cushion section for promoting the neck of the individual to contact said interior face of said rear cushion section; and said interior face of said second leg section including a second linear taper cushion surface abutting said interior face of said rear cushion section for promoting the neck of the individual to contact said interior face of said rear cushion section.

11. A head and neck support device as set forth in claim 7, wherein said lower face of said rear cushion section including a concave cushion surface for conforming to the back of the individual and for elevating said rear cushion section of said generally U-shaped cushion relative to the neck.

12. A head and neck support device as set forth in claim 7, wherein said interior face of said rear cushion section including a rear convex surface for conforming to the neck of the individual.

13. A head and neck support device for positioning about a neck of an individual, the neck joining a head with a torso of the individual, the torso having a first shoulder, a second shoulder, a back and a chest, the head and neck support device comprising;

a generally U-shaped cushion defining a rear cushion section, a first leg section and a second leg section, said rear cushion section defining an interior face, an exterior face, an upper face and a lower face;

said first leg section defining an interior face, an exterior face, an upper face, a lower face, an end face extending between a proximal end and a distal end;

said second leg section defining an interior face, an exterior face, an upper face, a lower face, an end face extending between a proximal end and a distal end;

a first leg groove traversing said exterior face of said first leg section;

a second leg groove traversing said exterior face of said second leg section;

a rear groove traversing said exterior face of said rear cushion section;

a rear supporting panel defining an interior surface, an exterior surface, an upper edge, a lower edge, a first side edge and a second side edge;

a primary supporting panel defining an interior surface, an exterior surface, an upper edge, a lower edge, a front side edge and a back side edge;

said first side edge of said rear supporting panel secured to said back side edge of said primary supporting panel for defining a primary generally L-shaped frame;

a secondary supporting panel defining an interior surface, an exterior surface, an upper edge, a lower edge, a front side edge and a back side edge;

said second side edge of said rear supporting panel secured to said back side edge of said secondary supporting panel for defining a secondary generally L-shaped frame;

said primary generally L-shaped frame and said secondary generally L-shaped frame defining a cushion enclosure frame and a cushion cavity;

said generally U-shaped cushion encircling the neck and positioned adjacent to the first shoulder and the second shoulder of the individual;

said first leg groove, said second leg groove and said rear groove receiving said primary supporting panel, said secondary supporting panel and said rear supporting panel respectively for interlocking said generally U-shaped cushion relative to said cushion enclosure frame;

said cushion enclosure frame encircling said generally U-shaped cushion for positioning said lower edge of said primary supporting panel and said adjacent to the first shoulder and said lower edge of said secondary supporting panel adjacent to the second shoulder;

said primary supporting panel applying a first opposing force in an inward direction towards the neck of the individual upon the displacement of the head and neck from a vertical position towards said primary supporting panel for preventing displacement of said first leg section of said generally U-shaped cushion relative to the neck and supporting the head and neck in a generally vertical position; and said secondary supporting panel applying a second opposing force in an inward direction towards the neck of the individual upon the displacement of the head and neck from a vertical position towards said secondary supporting panel for preventing displacement of said second leg section of said generally U-shaped cushion relative to the neck and supporting the head and neck in a generally vertical position.

14. A head and neck support device as set forth in claim 13, further including a first leg groove cover adjacent to said distal end of said first leg section and extending over said first leg groove for defining a first leg pocket;

a second leg groove cover adjacent to said distal end of said second leg section and extending over said second leg groove for defining a second leg pocket; and said first leg pocket and said second leg pocket receiving said primary supporting panel and said secondary supporting panel respectively for interlocking said generally U-shaped cushion relative to said cushion enclosure frame.

15. A head and neck support device as set forth in claim 13, further including a first cushion chamber in said first leg section for receiving a first additional cushion material;

a first cushion aperture in said first leg section for inputting said first additional cushion material into said first cushion chamber;

a first closure engaging said first cushion aperture for closing said first cushion aperture;

a second cushion chamber in said second leg section for receiving a second additional cushion material;

a second cushion aperture in said second leg section for inputting said second additional cushion material into said second cushion chamber;

a second closure engaging said second cushion aperture for closing said second cushion aperture;

a third cushion chamber in said rear cushion section for receiving a third additional cushion material;

a third cushion aperture in said rear cushion section for inputting said third additional cushion material into said third cushion chamber; and a third closure engaging said third cushion aperture for closing said third cushion aperture.

16. A head and neck support device as set forth in claim 13, wherein said secondary supporting panel applies a third opposing force in an outward direction away from the neck of the individual upon the displacement of the head and neck from a vertical position towards said primary supporting panel for preventing displacement of the first leg section of the generally U-shaped pillow relative to the neck and supporting the head and neck in a generally vertical position.

17. A head and neck support device as set forth in claim 13, wherein said primary supporting panel applies a fourth opposing force in an outward direction away from the neck of the individual upon the displacement of the head and neck from a vertical position towards said secondary supporting panel for preventing displacement of the second leg section of the generally U-shaped pillow relative to the neck and supporting the head and neck in a generally vertical position.

18. A head and neck support device as set forth in claim 13, wherein said rear supporting panel applies a fifth opposing force in an inward direction towards the neck of the individual upon the displacement of the head and neck from a vertical position towards said rear supporting panel for preventing displacement of the rear pillow section of the generally U-shaped pillow relative to the neck and supporting the head and neck in a generally vertical position.

19. A head and neck support device as set forth in claim 13, wherein said primary supporting panel applies a sixth opposing force in an outward direction away from the neck of the individual upon the displacement of the head and neck from a vertical position towards said rear supporting panel for preventing displacement of the rear pillow section of the generally U-shaped pillow relative to the neck and supporting the head and neck in a generally vertical position; and said secondary supporting panel applies a seventh opposing force in an outward direction away from the neck of the individual upon the displacement of the head and neck from a vertical position towards said rear supporting panel for preventing displacement of the rear pillow section of the generally U-shaped pillow relative to the neck and supporting the head and neck in a generally vertical position.

20. A head and neck support device as set forth in claim 13, further including a first hinge coupling said first side edge of said rear supporting panel and said back side edge of said primary supporting panel for pivoting said primary supporting panel between said primary generally L-shaped frame and a first parallel orientation with said rear supporting panel; and a second hinge coupling said second side edge of said rear supporting panel and said back side edge of said secondary supporting panel for pivoting said secondary supporting panel between said secondary generally L-shaped frame and a second parallel orientation with said rear supporting panel.

21. A head and neck support device for positioning about a neck of an individual, the neck joining a head with a torso of the individual, the torso having a first shoulder and a second shoulder, a generally U-shaped pillow encircling the neck and positioned adjacent to the first shoulder and the second shoulder of the individual, the generally U-shaped pillow having a rear pillow section, a first leg section and a second leg section, the head and neck support device, comprising;

a rear supporting panel defining an interior surface, an exterior surface, an upper edge, a lower edge, a first side edge and a second side edge;

a primary supporting panel defining an interior surface, an exterior surface, an upper edge, a lower edge, a front side edge and a back side edge;

said first side edge of said rear supporting panel secured to said back side edge of said primary supporting panel for defining a primary generally L-shaped frame;

a secondary supporting panel defining an interior surface, an exterior surface, an upper edge, a lower edge, a front side edge and a back side edge;

said second side edge of said rear supporting panel secured to said back side edge of said secondary supporting panel for defining a secondary generally L-shaped frame;

said primary generally L-shaped frame and said secondary generally L-shaped frame defining a pillow enclosure frame and a pillow cavity;

said pillow cavity receiving the generally U-shaped pillow for positioning said interior surface of said primary supporting panel adjacent to the first leg section of the generally U-shaped pillow and positioning said interior surface of said secondary supporting panel adjacent to the second leg section of the generally U-shaped pillow;

said pillow enclosure frame encircling the generally U-shaped pillow for positioning said lower edge of said primary supporting panel adjacent to the first shoulder and said lower edge of said secondary supporting panel adjacent to the second shoulder;

said primary supporting panel applying a first opposing force in an inward direction towards the neck of the individual upon the displacement of the head and neck from a vertical position towards said primary supporting panel for preventing displacement of the first leg section of the generally U-shaped pillow relative to the neck and supporting the head and neck in a generally vertical position;

said secondary supporting panel applying a second opposing force in an inward direction towards the neck of the individual upon the displacement of the head and neck from a vertical position towards said secondary supporting panel for preventing displacement of the second leg section of the generally U-shaped pillow relative to the neck and supporting the head and neck in a generally vertical position;

said lower edge of said primary supporting panel includes a primary concave edge for conforming to the first shoulder of the individual; and said lower edge of said secondary supporting panel includes a secondary concave edge for conforming to the second shoulder of the individual.

22. A head and neck support device for positioning about a neck of an individual, the neck joining a head with a torso of the individual, the torso having a first shoulder and a second shoulder, a generally U-shaped pillow encircling the neck and positioned adjacent to the first shoulder and the second shoulder of the individual, the generally U-shaped pillow having a rear pillow section, a first leg section and a second leg section, the head and neck support device, comprising;

a rear supporting panel defining an interior surface, an exterior surface, an upper edge, a lower edge, a first side edge and a second side edge;

a primary supporting panel defining an interior surface, an exterior surface, an upper edge, a lower edge, a front side edge and a back side edge;

said first side edge of said rear supporting panel secured to said back side edge of said primary supporting panel for defining a primary generally L-shaped frame;

a secondary supporting panel defining an interior surface, an exterior surface, an upper edge, a lower edge, a front side edge and a back side edge;

said second side edge of said rear supporting panel secured to said back side edge of said secondary supporting panel for defining a secondary generally L-shaped frame;

said primary generally L-shaped frame and said secondary generally L-shaped frame defining a pillow enclosure frame and a pillow cavity;

said pillow cavity receiving the generally U-shaped pillow for positioning said interior surface of said primary supporting panel adjacent to the first leg section of the generally U-shaped pillow and positioning said interior surface of said secondary supporting panel adjacent to the second leg section of the generally U-shaped pillow;

said pillow enclosure frame encircling the generally U-shaped pillow for positioning said lower edge of said primary supporting panel adjacent to the first shoulder and said lower edge of said secondary supporting panel adjacent to the second shoulder;

said primary supporting panel applying a first opposing force in an inward direction towards the neck of the individual upon the displacement of the head and neck from a vertical position towards said primary supporting panel for preventing displacement of the first leg section of the generally U-shaped pillow relative to the neck and supporting the head and neck in a generally vertical position;

said secondary supporting panel applying a second opposing force in an inward direction towards the neck of the individual upon the displacement of the head and neck from a vertical position towards said secondary supporting panel for preventing displacement of the second leg section of the generally U-shaped pillow relative to the neck and supporting the head and neck in a generally vertical position; and said upper edge of said rear supporting panel includes a rear concave edge for conforming to the head of the individual.

* * * * *